US012116862B2

(12) United States Patent
Al-Ramadhan

(10) Patent No.: US 12,116,862 B2
(45) Date of Patent: Oct. 15, 2024

(54) DUAL DETACHED WIPER PLUG SYSTEM FOR CEMENTING OPERATION

(71) Applicant: Saudi Arabian Oil Company, Dhahran (SA)

(72) Inventor: Ahmed A. Al-Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 88 days.

(21) Appl. No.: 17/967,464

(22) Filed: Oct. 17, 2022

(65) Prior Publication Data

US 2024/0125200 A1 Apr. 18, 2024

(51) Int. Cl.
*E21B 33/16* (2006.01)
*E21B 34/14* (2006.01)

(52) U.S. Cl.
CPC ..... *E21B 33/16* (2013.01); *E21B 34/142* (2020.05)

(58) Field of Classification Search
CPC ..... E21B 33/16; E21B 34/142
See application file for complete search history.

(56) References Cited

U.S. PATENT DOCUMENTS

| | | | | |
|---|---|---|---|---|
| 4,671,358 | A * | 6/1987 | Lindsey, Jr. | E21B 34/14 166/291 |
| 6,799,638 | B2 | 10/2004 | Butterfield, Jr. | |
| 9,200,499 | B2 * | 12/2015 | Hall | E21B 33/16 |
| 9,303,482 | B2 | 5/2016 | Hall et al. | |
| 2013/0333873 | A1 * | 12/2013 | Giroux | E21B 47/09 166/66.6 |

FOREIGN PATENT DOCUMENTS

| | | | |
|---|---|---|---|
| WO | 2012125660 | A3 | 9/2012 |
| WO | 2015163902 | A1 | 10/2015 |

* cited by examiner

*Primary Examiner* — Crystal J Lee
(74) *Attorney, Agent, or Firm* — Dinsmore & Shohl LLP

(57) ABSTRACT

A cementing string assembly for cementing a liner in a wellbore includes a drill pipe, a liner hanger running tool attached to the drill pipe, a liner releasably secured to the liner hanger running tool, an upper wiper plug disposed within the liner and releasably secured to the liner hanger running tool or to the liner, and a lower wiper plug disposed within the liner and releasably secured to the liner downhole of the upper wiper plug. The lower wiper plug is detached from the upper wiper plug. The lower wiper plug is releasably secured to an inner surface of the liner by a wiper plug hanging collar and is releasable from the liner independent of the upper wiper plug and without exerting forces on the upper wiper plug. The cementing string assembly prevent premature and unintentional release of the upper wiper plug while releasing the lower wiper plug.

18 Claims, 10 Drawing Sheets

DUAL DETACHED WIPER PLUG SYSTEM FOR CEMENTING OPERATION

BACKGROUND

Field

The present disclosure relates to natural resource well drilling and hydrocarbon production from subterranean geologic formations, in particular, to cementing assemblies with wiper plug systems for cementing a liner in a wellbore.

Technical Background

Extracting hydrocarbons from subterranean sources often includes drilling one or more wellbores from the surface to a subterranean geological formation containing the hydrocarbons. The wellbore forms a pathway that permits both fluids and apparatus to traverse between the surface and the subterranean geologic formation. The wellbore can contain at least a portion of a fluid conduit that links the interior of the wellbore to the surface. The fluid conduit connecting the interior of the wellbore to the surface can permit regulated fluid flow from the interior of the wellbore to the surface and allow for access between equipment on the surface and the interior of the wellbore. The wellbore is initially formed by operating a drill string to bore into the earth. After drilling through each interval of the wellbore, the drill string is removed and a liner is generally installed and cemented in the interval of the wellbore to stabilize the wellbore wall and provide fluid isolation between the wellbore and the subterranean geologic formations through which the wellbore passes. Following installation of a liner, the drill string can then be inserted downhole again to drill the next interval of the wellbore. When the wellbore reaches the target subterranean geologic formation, the wellbore can be completed for production of hydrocarbons from or injection of treatment fluids into the subterranean geologic formation.

SUMMARY

The present disclosure is directed to cementing string assemblies for installing a liner in a wellbore and methods of cementing a liner in a wellbore using the cementing string assemblies. Conventional cementing strings typically include a liner hanger, liner hanger running tool, a liner string, an upper wiper plug releasably secured to the liner hanger running tool, and a lower wiper plug releasably secured to the upper wiper plug, among other components. During cementing, the lower wiper plug is released from the upper wiper plug and travels downhole to wipe drilling mud from the inner surface of the liner string to reduce contamination of the cement slurry, which is water-based, with the drilling mud, which is generally oil-based. Following pumping a fixed volume of cement slurry downhole and into the annulus, the upper wiper plug is released and travels downhole to wipe residual cement slurry from the inner surface of the liner string before pumping drilling mud downhole. Since the lower wiper plug is releasably secured to the upper wiper plug, releasing the lower wiper plug can often exert forces on the upper wiper plug, which can result in inadvertent and premature release of the upper wiper plug from the liner hanger running tool. Premature release of the upper wiper plug can inhibit proper cementing of the liner string in the wellbore, which leads pulling the recoverable components of the cementing string, drilling out the bottom of the wellbore again, and re-running the cementing string downhole. This can lead to significant drilling downtime and can substantially increase the cost of drilling and completing the wellbore.

Therefore, an ongoing need exists for cementing string assemblies that can reduce or prevent the occurrence of premature release of the upper wiper plug during release of the lower wiper plug. The present disclosure is directed to cementing string assemblies that include a liner hanger running tool, a liner, a liner hanger, an upper wiper plug, and a lower wiper plug. The upper wiper plug is releasably secured to the liner hanger running tool or to an inner surface of the liner. The lower wiper plug is separately and releasably secured to the inner surface of the liner using a lower wiper plug hanging collar rigidly attached to the inner surface of the liner. The lower wiper plug is detached from the upper wiper plug and separately releasable from the lower wiper plug hanging collar so that release of the lower wiper plug does not produce any incremental forces on the upper wiper plug that would be sufficient to cause the upper wiper plug to prematurely release. The cementing string assemblies of the present disclosure may reduce or prevent inadvertent and premature release of the upper wiper plug during release of the lower wiper plug, which can reduce downtime and prevent incurring additional cost of drilling and completing the wellbore, among other features.

According to a first aspect of the present disclosure, a cementing string assembly for cementing a liner in a wellbore may comprise a drill pipe, a liner hanger running tool attached to a downhole end of the drill pipe, a liner releasably secured to the drill pipe by the liner hanger running tool, an upper wiper plug disposed within the liner and releasably secured to the liner hanger running tool or to the liner, and a lower wiper plug disposed within the liner and releasably secured to the liner downhole of the upper wiper plug. The lower wiper plug may be detached from the upper wiper plug. The lower wiper plug may be releasably secured to an inner surface of the liner by a wiper plug hanging collar. The lower wiper plug may be releasable from the liner independent of the upper wiper plug and without exerting incremental forces on the upper wiper plug.

A second aspect of the present disclosure may include the first aspect, where the lower wiper plug may be releasably secured to the wiper plug hanging collar by a pin coupled to the wiper plug hanging collar.

A third aspect of the present disclosure may include the second aspect, where the pin may be a shear pin rigidly attached to the wiper plug hanging collar.

A fourth aspect of the present disclosure may include either one of the second or third aspects, where the pin may be received in a recess in a body of the lower wiper plug.

A fifth aspect of the present disclosure may include any one of the first through fourth aspects, where the wiper plug hanging collar may comprise a drillable material, where the drillable material may comprise cement, a drillable metal, or a combination of both.

A sixth aspect of the present disclosure may include any one of the first through fifth aspects, where the wiper plug hanging collar may be rigidly attached to the inner surface of the liner.

A seventh aspect of the present disclosure may include any one of the first through sixth aspects, where the wiper plug hanging collar may comprise an inner surface shaped to receive an uphole end of the lower wiper plug.

An eighth aspect of the present disclosure may include the seventh aspect, where the inner surface of the wiper plug hanging collar may define a central bore extending axially through the wiper plug hanging collar, where the lower wiper plug may be releasably secured to the inner surface of the wiper plug hanging collar.

A ninth aspect of the present disclosure may include either one of the seventh or eighth aspects, where the inner surface of the wiper plug hanging collar may comprise a frustoconical profile at an uphole end of the wiper plug hanging collar, the frustoconical profile may comprise a first diameter at the uphole end of the wiper plug hanging collar and a second diameter downhole of the first diameter, and the first diameter may be larger than the second diameter.

A tenth aspect of the present disclosure may include any one of the first through ninth aspects, where the wiper plug hanging collar may comprise a retractable pin, a motor, and an RFID receiver.

An eleventh aspect of the present disclosure may include the tenth aspect, further comprising an electrical power source electrically coupled to the RFID receiver and the motor.

A twelfth aspect of the present disclosure may include either one of the tenth or eleventh aspects, where the retractable pin may be movable between an extended position and a retracted position, the retractable pin may engage with the lower wiper plug in the extended position to secure the lower wiper plug to the wiper plug hanging collar in the extended position and may release the lower wiper plug from the wiper plug hanging collar when in the retracted position, and the motor may be in electronic communication with the RFID receiver and operatively connected to the retractable pin. When operated, the motor may move the retractable pin between the extended position and the retracted position. The RFID receiver may be configured to recognize when a lower plug dart RFID tag is proximate the wiper plug hanging collar and to operate the motor to retract the retractable pin when the RFID receiver recognizes the lower plug dart RFID tag is proximate the wiper plug hanging collar.

A thirteenth aspect of the present disclosure may include the twelfth aspect, where the RFID receiver may comprise at least one processor, at least one memory module, and machine readable and executable instructions stored on the at least one processor. The machine readable and executable instructions, when executed by the processor, may cause the RFID receiver to automatically determine a position of a lower plug dart RFID tag attached to a lower plug dart, determine whether the lower wiper plug dart is seated in the lower wiper plug from the positon of the lower wiper plug dart RFID tag, and when the lower wiper plug dart is seated in the lower wiper plug, operating the motor to move the retractable pin from the extended position to the retracted position.

A fourteenth aspect of the present disclosure may include any one of the first through thirteenth aspects, where the lower wiper plug may comprise a body having an inner surface and an outer surface and a plurality of wipers attached to an outer surface of the body and extending radially outward from the outer surface of the body. The inner surface of the body may define an internal cavity extending axially through the lower wiper plug from an uphole end to a downhole end of the lower wiper plug.

A fifteenth aspect of the present disclosure may include the fourteenth aspect, where the inner surface of the body of the lower wiper plug may comprise a lower dart seat and an upper wiper plug seat disposed uphole from the lower plug dart seat. The lower plug dart seat may be shaped to receive a lower wiper plug dart, and the upper wiper plug seat may be shaped to receive a nose of the upper wiper plug.

A sixteenth aspect of the present disclosure may include any one of the first through fifteenth aspects, where the lower wiper plug may have a lower dart seat having a smallest inner diameter that may be less than a smallest inner diameter of an upper plug dart seat of the upper wiper plug.

A seventeenth aspect of the present disclosure may include the sixteenth aspect, where the smallest inner diameter of the lower plug dart seat and the smallest inner diameter of the upper plug dart seat may both be large enough to pass a liner hanger setting ball through the upper wiper plug and the lower wiper plug without releasing the upper wiper plug or the lower wiper plug.

An eighteenth aspect of the present disclosure may include any one of the first through seventeenth aspects, where the lower wiper plug may comprise one or a plurality of side cement ports extending radially outward through a body of the lower wiper plug.

A nineteenth aspect of the present disclosure may include any one of the first through eighteenth aspects, where the upper wiper plug may be releasably secured to the liner hanger running tool.

A twentieth aspect of the present disclosure may include the nineteenth aspect, where the liner hanger running tool may comprise an inner string extending in a downhole direction from the liner hanger running tool and the upper wiper plug may be releasably secured to a downhole end of the inner string of the liner hanger running tool.

A twenty-first aspect of the present disclosure may include any one of the first through twentieth aspects, where the upper wiper plug may be releasably secured to an inner surface of the liner by an upper wiper plug hanging collar.

A twenty-second aspect of the present disclosure may include any one of the first through twenty-first aspects, where the lower wiper plug may be spaced apart from the upper wiper plug.

A twenty-third aspect of the present disclosure may include any one of the first through twenty-second aspects, where the lower wiper plug does not contact the upper wiper plug.

A twenty-fourth aspect of the present disclosure may include any one of the first through twenty-third aspects, where the lower wiper plug may not be rigidly attached or releasably secured to the upper wiper plug.

A twenty-fifth aspect of the present disclosure may include any one of the first through twenty-fourth aspects, further comprising a liner hanger secured to an outer surface of the liner proximate to an uphole end of the liner.

A twenty-sixth aspect of the present disclosure may include any one of the first through twenty-fifth aspects, further comprising a landing collar rigidly secured to a downhole end of the liner, where the landing collar may comprise a wiper plug seat shaped to receive a downhole end of the lower wiper plug.

A twenty-seventh aspect of the present disclosure may include the twenty-sixth aspect, further comprising a float collar, a float shoe, or both disposed downhole from the landing collar.

A twenty-eighth aspect of the present disclosure may include any one of the first through twenty-seventh aspects and may be directed to a method of cementing a liner in a wellbore, where the method comprises running the cementing string assembly of any one of the first through twenty-seventh aspects into the wellbore to a liner setting depth. The cementing string assembly may further comprise a landing collar rigidly secured to a downhole end of the liner. The landing collar may comprises a wiper plug seat shaped to receive a downhole end of the lower wiper plug and a liner hanger secured to an outer surface of the liner proximate to an uphole end of the liner. The method may further include setting the liner hanger; after setting the liner hanger, releasing the lower wiper plug from the lower wiper hanging collar; pumping a first spacer fluid downhole followed by a cement slurry, where flow of the spacer fluid and the cement slurry may move the lower wiper plug downhole through the liner to the landing collar, where the lower wiper plug may seat in the landing collar; and after the lower wiper plug seats in the landing collar, continuing pumping the cement slurry downhole, where continued flow of cement slurry may cause the spacer fluid and the cement slurry to flow through the lower wiper plug and the landing collar, and into an annulus defined between an outer surface of the liner and a wellbore wall of the wellbore. The method may further include releasing the upper wiper plug; pumping a second spacer fluid downhole followed by drilling mud, where the flow of the second spacer fluid and drilling mud may move the upper wiper plug downhole through the liner to the landing collar, where the upper wiper plug may seat in the lower wiper plug and blocks at least one side cement port in the lower wiper plug; ceasing pumping the drilling fluid downhole; and curing the cement slurry in the annulus.

A twenty-ninth aspect of the present disclosure may include the twenty-eighth aspect, where releasing the lower wiper plug may comprise dropping a lower plug dart downhole. The lower plug dart may seat in a lower dart seat in the lower wiper plug. When seated, the lower plug dart may block a downhole opening in the lower wiper plug, which may restrict flow of materials through only the at least one side cement port of the lower wiper plug. The fluid pressure caused by restricting the flow of materials only through the at least one side cement port may shear a lower plug shear pin, which may release the lower wiper plug from the lower wiper plug hanging collar.

A thirtieth aspect of the present disclosure may include either one of the twenty-eighth or twenty-ninth aspects, where the lower wiper plug hanging collar may comprise an RFID receiver, a motor electrically coupled to the RFID receiver, and a retractable pin operatively coupled to the motor, where the retractable pin may secure the lower wiper plug to the lower wiper plug hanging collar when the retractable pin is in an extended position. Releasing the lower wiper plug may comprise dropping a lower plug dart downhole, where the lower plug dart may comprise a lower dart RFID tag; seating the lower plug dart in a lower dart seat of the lower wiper plug; reading the lower dart RFID tag with the RFID receiver; determining that the lower plug dart is seated in the lower wiper plug from a position of the lower dart RFID tag relative to the RFID receiver; and after determining that the lower plug dart is seated in the lower wiper plug, operating the motor to move the retractable pin from an extended position to a retracted position, which may release the lower wiper plug from the lower wiper plug hanging collar.

A thirty-first aspect of the present disclosure may include the thirtieth aspect, where the lower wiper plug hanging collar may further comprise an electrical power source electrically coupled to the RFID receiver and the motor.

A thirty-second aspect of the present disclosure may include any one of the twenty-eighth through thirty-first aspects, where movement of the lower wiper plug downhole through the liner may wipe drilling fluid off of the inner surface of the liner to reduce or prevent contamination of the cement slurry with the drilling fluid.

A thirty-third aspect of the present disclosure may include any one of the twenty-eighth through thirty-second aspects, where ceasing pumping the drilling fluid downhole may comprise detecting an increase in fluid pressure at the surface caused by blocking the at least one side cement port in the lower wiper plug by the upper wiper plug; and in response to the increase in fluid pressure, ceasing pumping the drilling fluid downhole.

Additional features and advantages of the technology described in this disclosure will be set forth in the detailed description that follows, and in part will be readily apparent to those skilled in the art from the description or recognized by practicing the technology as described in this disclosure, including the detailed description that follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 1:
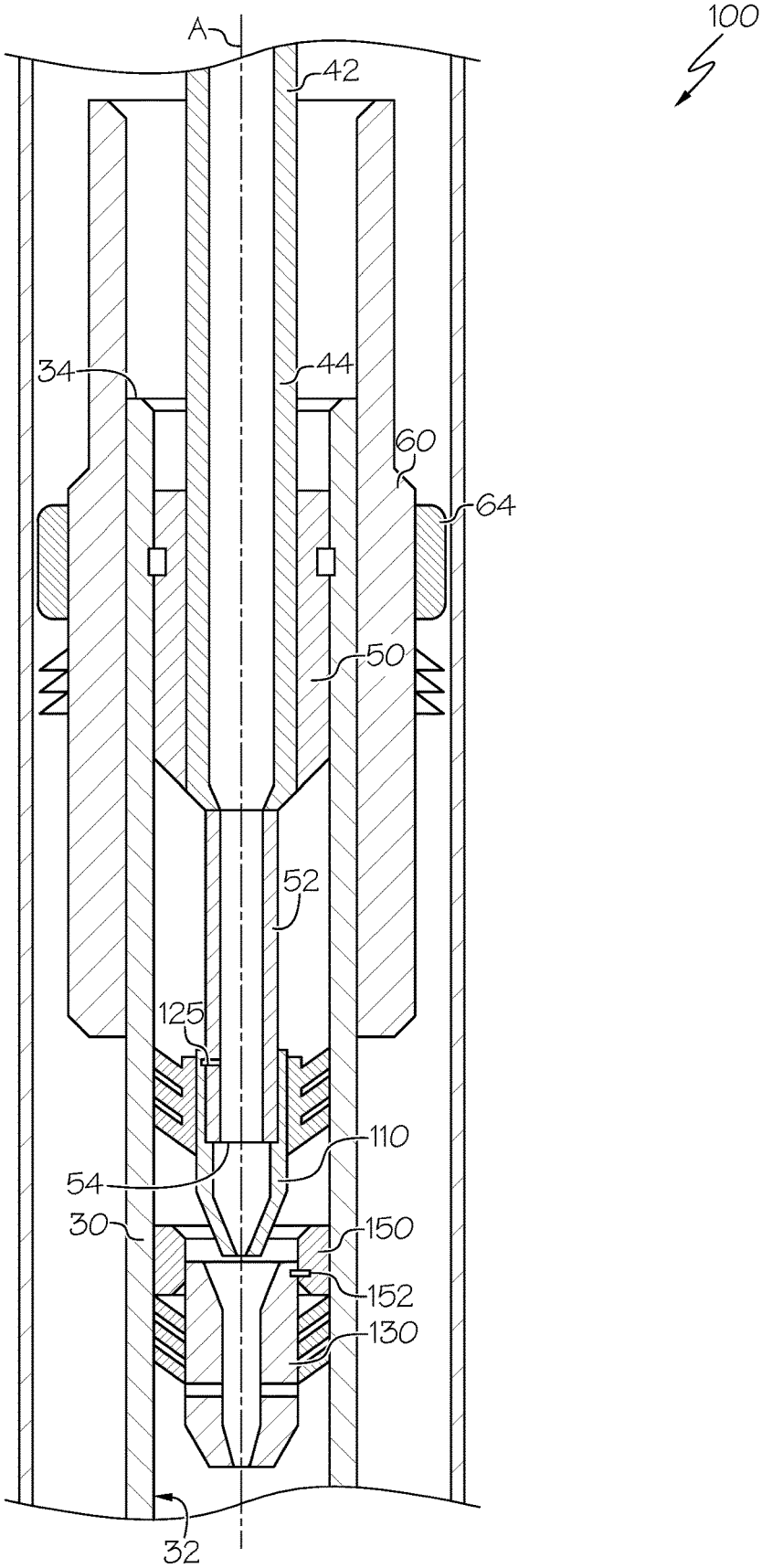
FIG. 1 schematically depicts a front cross-sectional view of a portion of a cementing string, according to one or more embodiments shown and described in this disclosure.

The present disclosure is directed to cementing string assemblies and methods of using the cementing string assemblies to install a liner in a wellbore. Referring now to FIG. 1, one embodiment of a cementing string assembly 100 for cementing a liner 30 in a wellbore is schematically depicted. The cementing string assembly 100 can include a drill pipe 42, a liner hanger running tool 50 attached to a downhole end 44 of the drill pipe 42, a section of the liner 30 releasably secured to the drill pipe 42 by the liner hanger running tool 50, an upper wiper plug 110 disposed within the liner 30 and releasably secured to the liner hanger running tool 50 or to the liner 30, and a lower wiper plug 130 disposed within the liner 30 and releasably secured to the liner 30 downhole of the upper wiper plug 110. The lower wiper plug 130 may be detached from the upper wiper plug 110. The lower wiper plug 130 may be releasably secured to an inner surface 32 of the liner 30 by a lower wiper plug hanging collar 150. The lower wiper plug 130 may be releasable from the liner 30 independent of the upper wiper plug 110 and without exerting incremental forces on the upper wiper plug 110.

In the cementing string assemblies 100 of the present disclosure, the lower wiper plug 130 is detached from the upper wiper plug 110 and is releasably secured to the liner 30 separate and independent of the upper wiper plug 110. Separately and independently securing the lower wiper plug 130 to the liner 30 may reduce or prevent the probability of inadvertently and prematurely releasing the upper wiper plug 110 by reducing or eliminating incremental forces being exerted on the upper wiper plug 110 while releasing the lower wiper plug 130. Reducing or eliminating the probability of inadvertent and premature release of the upper wiper plug 110 while releasing the lower wiper plug 130 can avoid costly downtime caused by having to pull the recoverable parts of the cementing string assembly, reassembling the cementing string assembly, and re-run the cementing string assembly downhole.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean geologic formation," "subterranean formation," or just "formation" may refer to a subterranean geologic region that contains hydrocarbons or a subterranean geologic region proximate to a hydrocarbon-bearing formation, such as a subterranean geologic region to be treated for purposes of enhanced oil recovery or reduction of water production or a subterranean geologic region that must be drilled through to get to the hydrocarbon-bearing formation.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component. The terms "uphole" and "downhole" are not intended to imply a vertical arrangement but rather are directions along a center axis of the wellbore relative to the surface.

The terms "upper" and "lower" are relative to the axial direction in the wellbore and may not necessarily refer to direction with respect to the force of gravity. In other words, the term "upper" refers to a relative position of a first component uphole from a second component, and the term "lower" refers to a relative position of a first component downhole from a second component.

As used throughout the present disclosure, the term "fluid" includes liquids, gases, or both and may include solids in combination with the liquids, gases, or both, such as but not limited to suspended solids in the wellbore fluids; entrained particles in gas produced from the wellbore; drilling fluids comprising weighting agents, lost circulation materials, cuttings, or other solids; or other mixed phase suspensions, slurries and other fluids.

As used in the present disclosure, a fluid passing from a first feature "directly" to a second feature refers to the fluid passing from the first feature to the second feature without passing or contacting a third feature intervening between the first and second feature.

As used throughout the present disclosure, the term "releasably secured" refers to a first component being secured to a second component in a manner that enables the first component to be deliberately and intentionally detached or released from the second component.

Figure 2:
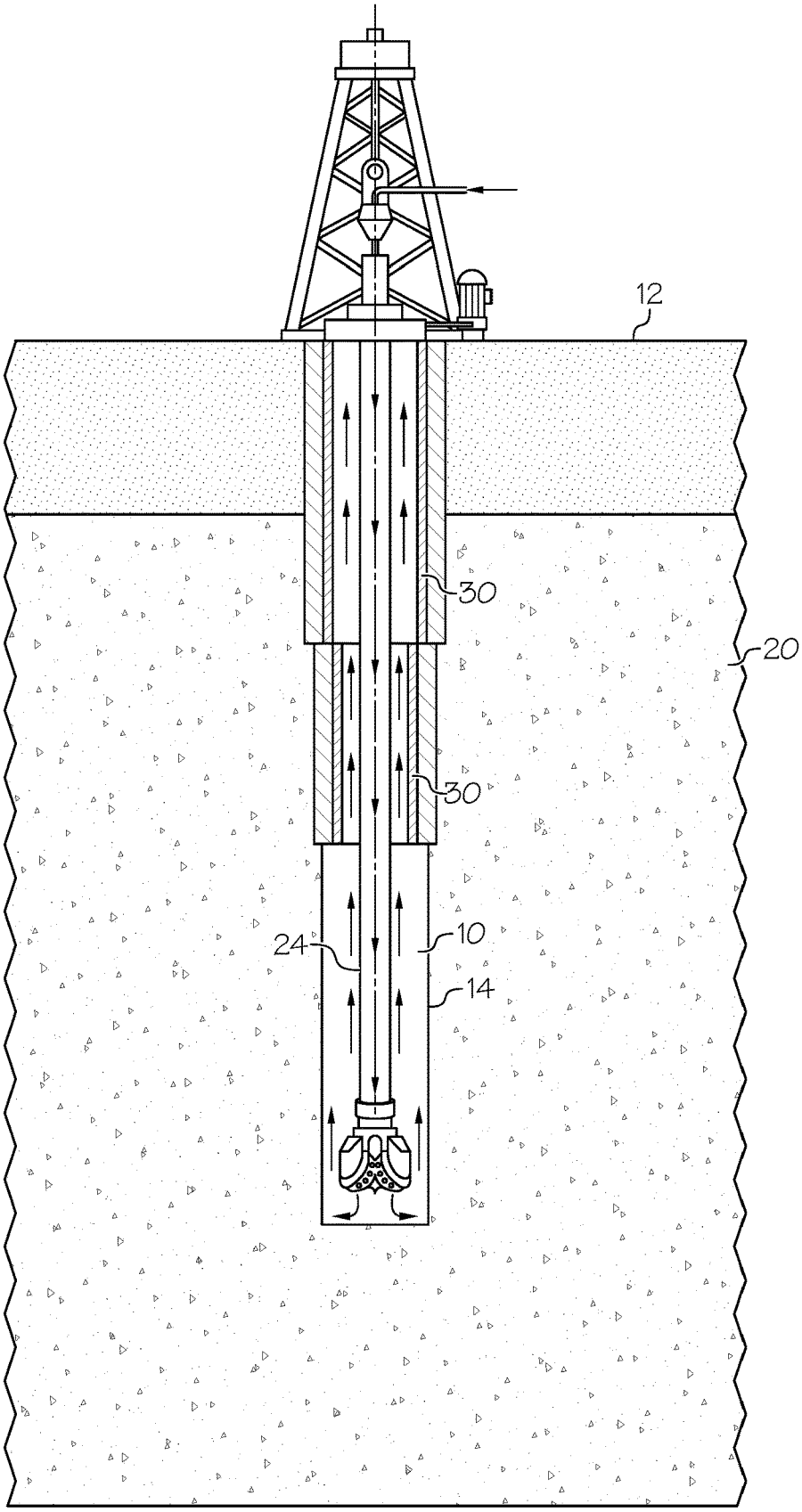
FIG. 2 schematically depicts a wellbore drilling operation, according to one or more embodiments shown and described in this disclosure.

Referring now to FIG. 2, a wellbore 10 extending from the surface 12 into a subterranean formation 20 is schematically depicted. The wellbore 10 forms a pathway capable of permitting both fluids and apparatus to traverse between the surface 12 and the subterranean formation 20, such as a hydrocarbon-bearing subterranean formation. Besides defining the void volume of the wellbore 10, the wellbore wall 14 also acts as an interface through which fluid can transition between the subterranean formation 20 and the interior of the wellbore 10. The wellbore wall 14 can be unlined (that is, bare rock or formation) to permit such interaction with the formation or lined, such as by a liner 30, to prevent or control such interactions. During drilling of the wellbore 10, the portion of the wellbore 10 being drilled is generally unlined until the drill string 24 can be pulled out of the wellbore 10 and a section of the liner 30 positioned and cemented in place across the interval.

The wellbore 10 may include at least a portion of a fluid conduit that links the interior of the wellbore 10 to the surface 12. The fluid conduit connecting the interior of the wellbore 10 to the surface 12 can be capable of permitting regulated fluid flow from the interior of the wellbore 10 to the surface 12 and can permit access between equipment on the surface 12 and the interior of the wellbore 10. Example equipment connected at the surface 12 to the fluid conduit may include but is not limited to pipelines, tanks, pumps, compressors, and flares. The fluid conduit may be large enough to permit introduction and removal of mechanical devices, including but not limited to tools, drill strings, sensors, instruments, or combinations of these into and out of the interior of the wellbore 10.

Referring again to FIG. 2, a drilling apparatus comprising a drill string 24 may be used to drill the wellbore 10 into the subterranean formation 20. The drilling apparatus with the drill string 24 may be used to drill an interval of the wellbore 10 through the subterranean formation 20. After each interval, the drill string 24 may be removed from the wellbore 10 and a liner 30 installed in the wellbore 10. The liner 30 may provide support to the wellbore wall 14 and may provide isolation of the wellbore 10 from the subterranean formation 20 to control the flow of formation fluids from the subterranean formation 20 into the wellbore 10.

Figure 3:
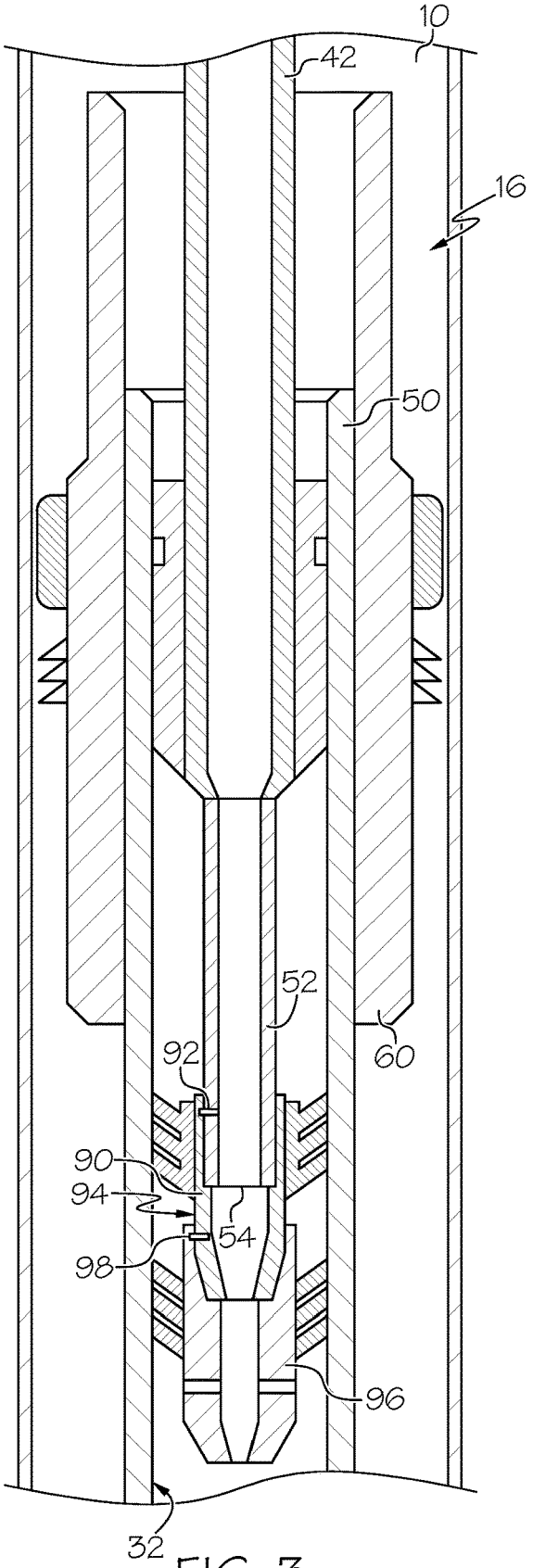
FIG. 3 (PRIOR ART)
FIG. 3 schematically depicts a front cross-sectional view of a portion of a cementing string, according to the prior art.

The liner 30 may be installed in the wellbore 10 using a cementing string comprising a section of liner 30. Referring now to FIG. 3, a conventional cementing string 40 is schematically depicted. The conventional cementing string 40 can include a drill pipe 42, a liner hanger running tool 50 coupled to a downhole end of the drill pipe 42, and a liner 30 releasably secured to the liner hanger running tool 50. The conventional cementing string 40 can further include a liner hanger 60 secured to an outer surface of the liner 30, a landing collar (not shown) coupled to a downhole end of the liner 30, and a cementing shoe (not shown) secured to the landing collar and disposed downhole of the landing collar.

The conventional cementing string 40 typically includes an upper wiper plug 90 releasably secured to a downhole end of the inner string 52 with a first shear pin 92 and having an outer surface 94. The conventional cementing string 40 typically includes a lower wiper plug 96 releasably secured to the upper wiper plug 90 with a second shear pin 98. In many cases, the lower wiper plug 96 is releasably secured to the outer surface 94 of the upper wiper plug 90. Thus, in a conventional cementing string 40 the upper wiper plug 90 and the lower wiper plug 96 are secured to each other and in contact with each other when the conventional cementing string 40 is run downhole. The second shear pin 98 may shear at an applied shear force that is less than the applied shear force needed to shear the first shear pin 92, which provides the ability to release the lower wiper plug 96 while retaining the upper wiper plug 90 releasably secured to the inner string 52.

The conventional cementing string 40 can be used to install the liner 30 in the newly drilled interval of the wellbore 10. To install the liner 30, the conventional cementing string 40 is run into the wellbore 10 downhole to a liner depth, at which depth the liner 30 traverses the interval over which the liner 30 is to be installed. Once the conventional cementing string 40 is positioned, the liner hanger 60 is set to fix the downhole position of the liner 30 in the wellbore 10. Next, a first dart is inserted into the drill pipe 42 and seated into the center of the lower wiper plug 96. After the first dart is seated in the lower wiper plug 96, a fixed volume of spacer fluid is pumped downhole followed by a cement slurry. The first dart seals the bottom opening in the lower wiper plug 96 so that the hydraulic pressure of the spacer fluid and cement slurry pumped downhole exerts a downward pressure that causes the second shear pin 98 to shear to release the lower wiper plug 96 from the upper wiper plug 90. Once released, the lower wiper plug 96 travels downhole through the liner 30 and wipes the inner surface 32 of the liner 30 to remove drilling fluids from the inner surface 32 of the liner 30, which reduces contamination of the cement slurry.

When the lower wiper plug 96 reaches the landing collar, the lower wiper plug 96 seats in the landing collar. The spacer fluid and cement slurry then flow through the lower wiper plug 96, the landing collar, and the cement shoe. The spacer fluid and cement slurry then flow back uphole into the annulus defined between an outer surface of the liner 30 and the wellbore wall 14. The cement slurry is pumped downhole until the cement slurry fills the annulus between the liner 30 and the wellbore wall 14. After the last of the cement slurry is pumped downhole past the upper wiper plug 90, a second dart is run downhole to seat in the upper wiper plug 90. Wellbore fluids are then pumped downhole, causing the first shear pin 92 to shear and release the upper wiper plug 90 from the liner hanger running tool 50 or inner string 52. Further pumping of wellbore fluids into the drill pipe 42 can cause the upper wiper plug 90 to travel downhole through the liner 30 to wipe the residual cement materials from the inner surface 32 of the liner 30. At the landing collar, the upper wiper plug 90 seats into a recess in the lower wiper plug 96.

As shown in FIG. 3, in the conventional cementing strings 40, the upper wiper plug 90 and the lower wiper plug 96 are mounted in series. In particular, for conventional cementing strings 40 the upper wiper plug 90 is typically releasably secured to liner hanger running tool 50, such as to the inner string 52 of the liner hanger running tool 50, with the first shear pin 92, and the lower wiper plug 96 is releasably attached to the upper wiper plug 90 with the second shear pin 98. The force required to shear the second shear pin 98 is less than the force required to shear the first shear pin 92. In the conventional cementing strings 40, the upper wiper plug 90 and the lower wiper plug 96 are designed to be released independently (through the difference in force required to shear the first shear pin 92 and the second shear pin 98) but are not truly separated from each other since the lower wiper plug 96 is still attached to the upper wiper plug 90 by the second shear pin 98. This attachment of the lower wiper plug 96 to the upper wiper plug 90 can cause the upper wiper plug 90 to unintentionally and prematurely release from the liner hanger running tool 50 and to travel downhole with the lower wiper plug 96 since both are impacted by the applied pressure when the first dart lands in the lower wiper plug 96. In other words, the force of the first dart landing on the lower wiper plug 96, the hydraulic pressure of the spacer fluids or cement slurry, or both can exert forces on the first shear pin 92. When these incremental forces exceed the shear force required to shear the first shear pin 92, the first shear pin 92 may shear, which results in unintentionally and prematurely releasing the upper wiper plug 90 while attempting to release the lower wiper plug 96.

When the upper wiper plug 90 is unintentionally and prematurely released while releasing the lower wiper plug 96, the upper wiper plug 90 travels downhole with the lower wiper plug 96. In some instances, the upper wiper plug 90 may still be connected to the lower wiper plug 96. At the downhole end of the liner 30, the upper wiper plug 90 seats in the lower wiper plug 96 soon after the lower wiper plug 96 lands in the landing collar, which closes off the annulus 16 before the cement slurry fills the annulus. This can result in complete failure of the cementing operation to cement the liner 30 in the wellbore 10 and retention of the cement slurry in the inside of the liner 30. Failure of the cementing operation requires retrieval of recoverable components of the conventional cementing string 40, drilling out the nonrecoverable components of the conventional cementing string 40 and any cured cement slurry, making up a new cementing string, and attempting to cement the liner again. This results in lost equipment and can lead to substantial delays in the drilling process. Therefore, an ongoing need exists for cementing string assemblies that reduce or prevent unintentional and premature release of the upper wiper plug 90 while releasing the lower wiper plug 96.

The present disclosure is directed to cementing string assemblies comprising an upper wiper plug and a lower wiper plug, where the lower wiper plug is detached from the upper wiper plug and releasably secured to the inner surface of the liner independent of the upper wiper plug. Referring again to FIG. 1, the cementing string assemblies 100 of the present disclosure may include the drill pipe 42, the liner hanger running tool 50 coupled to a downhole end 44 of the drill pipe 42, and the liner 30 releasably secured to the drill pipe 42 by the liner hanger running tool 50. The cementing string assembly 100 of the present disclosure further includes an upper wiper plug 110 disposed inside of the liner 30 and releasably secured to the liner hanger running tool 50 or to the liner 30. The cementing string assembly 100 further includes a lower wiper plug 130 disposed inside of the liner 30 and releasably secured to the liner 30 downhole of the upper wiper plug 110. The lower wiper plug 130 is detached from the upper wiper plug 110. The lower wiper plug 130 may be releasably secured to the inner surface 32 of the liner 30 by a lower wiper plug hanging collar 150. The lower wiper plug 130 may be independently and separately releasable from the cementing string assembly 100 without exerting any incremental force on the upper wiper plug 110.

By releasably securing the lower wiper plug 130 to the liner 30 with the lower wiper plug hanging collar 150 and detaching the lower wiper plug 130 from the upper wiper plug 110, releasing the lower wiper plug 130 from the lower wiper plug hanging collar 150 does not place any incremental pressure or forces on the upper wiper plug 110 above and beyond the forces acting on the upper wiper plug 110 before releasing the lower wiper plug 130. Landing the lower plug dart into the lower plug dart seat in the lower wiper plug 130 does not exert any pressure or force on the upper wiper plug 110 because there is no connection or mechanical contact between the lower wiper plug 130 and the upper wiper plug 110. Each of the lower wiper plug 130 and upper wiper plug 110 can be released separately and independently with a designated size drill pipe dart, as will be discussed in further detail in the present disclosure. Eliminating premature release of the upper wiper plug 110 during release of the lower wiper plug 130 can reduce or eliminate downtime and equipment loss caused by having to drill out the wiper plugs, landing collar, float collar, and float shoe, and having to make up and run a second cementing string to install the liner 30 over the interval.

Referring again to FIG. 1, as previously discussed, the cementing string assembly 100 may comprise the drill pipe 42, which may comprise one or a plurality of drill pipe sections coupling the cementing string assembly 100 to the surface 12 of the wellbore 10 and the drilling rig at the surface 12. The drill pipe 42 may provide a conduit through which tooling and cementing materials may be conveyed from the surface 12 down to the cementing string assembly 100 disposed downhole in the wellbore 10. The cementing string assembly 100 may have a center axis A, which may correspond to the center axis of the drill pipe 42. The uphole direction and downhole direction refer to axial directions relative to the center axis A of cementing string assembly 100.

The liner hanger running tool 50 may be rigidly secured to the downhole end 44 of the drill pipe 42. In embodiments, the liner hanger running tool 50 may be rigidly attached to an outer surface of the drill pipe 42 proximate the downhole end 44 of the drill pipe 42. The liner hanger running tool 50 may be operable to releasably secure the section of liner 30 to be installed to the drill pipe 42 so that the liner 30 can be run downhole into the wellbore 10. In embodiments, the liner hanger running tool 50 may be disposed inside of the liner 30, and the inner surface 32 of the liner 30 may be releasably secured to the liner hanger running tool 50. In embodiments, the liner hanger running tool 50 may include an inner string 52 extending downhole from a downhole end of the liner hanger running tool 50.

The cementing string assembly 100 may further comprise a liner hanger 60 secured to an outer surface of the liner 30 proximate to the uphole end 34 of the liner 30. The liner hanger 60 may be operable to secure the uphole end 34 of the liner 30 to the wellbore wall 14 or to a downhole end of a previously installed liner section. The liner hanger 60 can include an anchor operable to secure the liner hanger 60 to the wellbore wall 14 or previously installed liner section. The cementing string assembly 100 may further include a top packer 64. The top packer 64 may be operable to create a fluid-tight seal in the annulus defined between the outer surface of the liner hanger 60 and the wellbore wall 14 or an inner surface of a previously installed liner section. In embodiments, the liner hanger 60 can further include a liner tie-back receptacle secured to an uphole end of the liner 30, liner hanger 60, or both.

Figure 10:
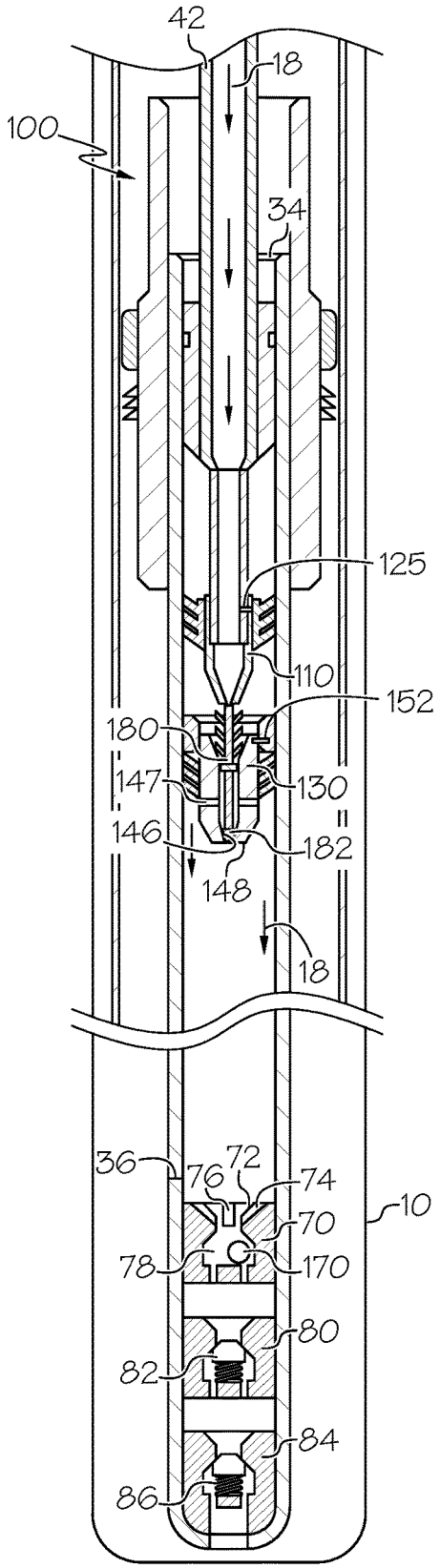
FIG. 10 schematically depicts a front cross-sectional view of the cementing string of FIG. 1 during release of the lower wiper plug from the lower wiper plug hanging collar, according to one or more embodiments shown and described in this disclosure.

Referring now to FIG. 10, the cementing string assembly 100 may further include a landing collar 70 rigidly secured to a downhole end 36 of the liner 30. The landing collar 70 may comprise a wiper plug seat 72 having a contour that is shaped to receive a downhole end of the lower wiper plug 130. In embodiments, the wiper plug seat 72 may be frustoconical. The wiper plug seat 72 may include grooves 74 or channels in the surface of the wiper plug seat 72. The grooves 74 may enable fluid flow downhole around the lower wiper plug 130 and through the landing collar 70 when the lower wiper plug 130 is seated in the wiper plug seat 72. The landing collar 70 may further include a central cavity 76.

Referring still to FIG. 10, the cementing string assembly 100 may further comprise a float collar 80 disposed downhole from the landing collar 70 and a float shoe 84 disposed downhole from the float collar 80. The float collar 80 may include a check valve 82 to prevent backflow of cement from the annulus 16 back into the cement string during cementing. In FIG. 10, the check valve 82 is shown as a float ball biased in the uphole direction against a ball seat, however, it is understood that the check valve 82 could include a flapper value, or any other type of check valve assembly. The float shoe 84 may also include a check valve 86.

Figure 4:
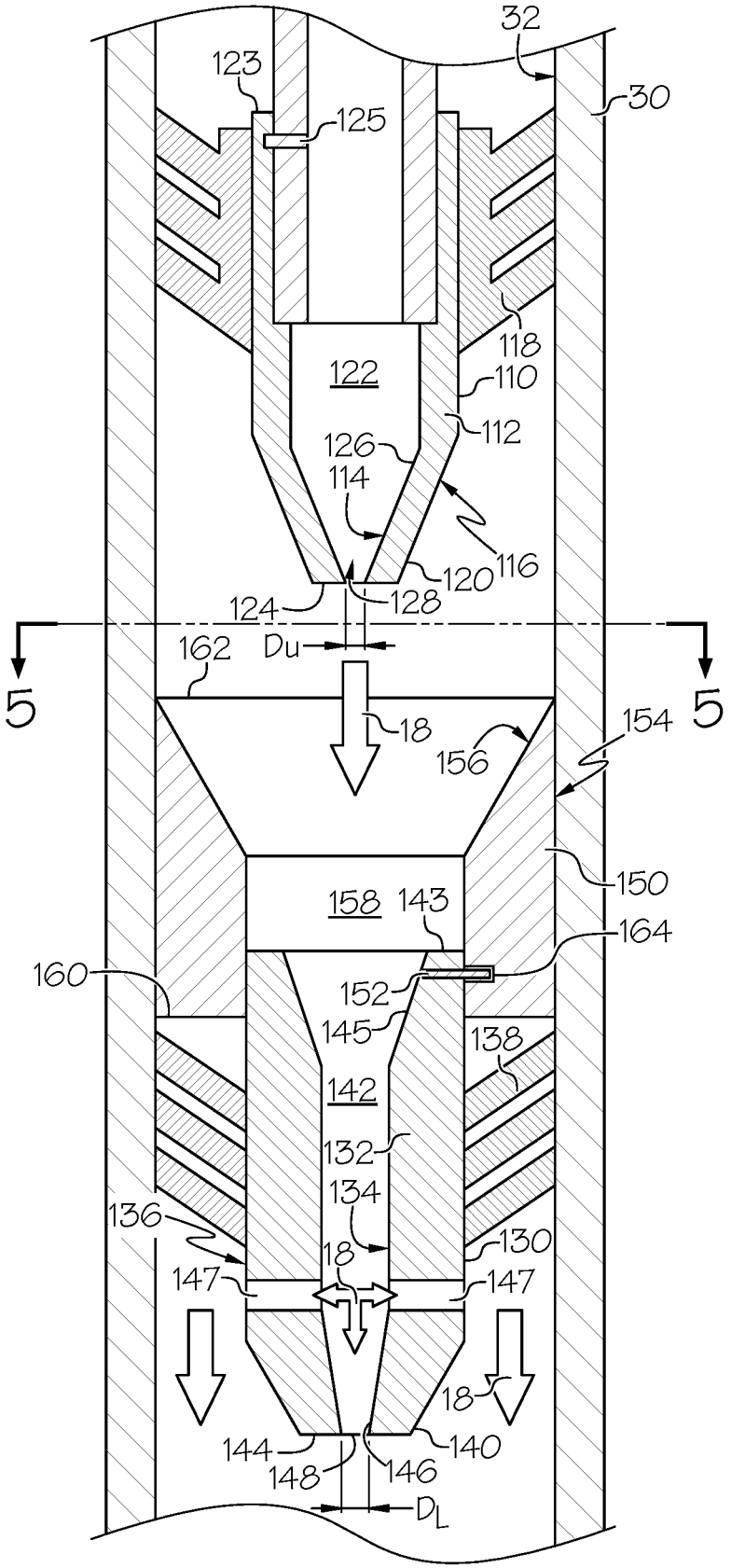
FIG. 4 schematically depicts a front cross-sectional view of an upper wiper plug, a lower wiper plug, and a lower wiper plug hanging collar of the cementing string of FIG. 1, according to one or more embodiments shown and described in this disclosure.

Referring again to FIG. 1, the cementing string assembly 100 further includes the upper wiper plug 110, the lower wiper plug 130, and the lower wiper plug hanging collar 150. The upper wiper plug 110 is disposed uphole relative to the lower wiper plug 130. Referring now to FIG. 4, a front cross-sectional view of the upper wiper plug 110, the lower wiper plug 130, and the lower wiper plug hanging collar 150 is schematically depicted. The upper wiper plug 110 may comprise a body 112, which may be a hollow cylindrical body comprising an inner surface 114 and an outer surface 116. The body 112 may be constructed of a drillable material, such as a rigid polymer or a drillable metal, such as aluminum or other soft metal. The upper wiper plug 110 may further include a plurality of wipers 118 coupled to the outer surface 116. Each of the wipers 118 may be an annular ring extending radially outward from the outer surface 116 of the upper wiper plug 110 and into contact with the inner surface 32 of the liner 30. Each of the wipers 118 may comprise a resilient material, such as a plastic or rubber material. The wipers 118 may wipe fluids and materials from the inner surface 32 of the liner 30 when the upper wiper plug 110 translates axially through the center of the liner 30.

The upper wiper plug 110 may include a nose 120 at the downhole end 124 of the upper wiper plug 110. At the nose 120, the outer surface 116 of the upper wiper plug 110 may taper from a larger outer diameter to a smaller outer diameter at the downhole end 124 of the upper wiper plug 110. In embodiments, the outer surface 116 in the nose 120 portion of the upper wiper plug 110 may have a frustoconical shape having an outer diameter that decreases from a larger outer diameter at the uphole end of the nose 120 to a smallest outer diameter at the downhole end of the upper wiper plug 110. The nose 120 portion of the upper wiper plug 110 may have any other suitable shape that tapers to a smallest outer dimension at the downhole end 124 of the upper wiper plug 110. In embodiments, the body 112 of the upper wiper plug 110 may not have any radial openings or side openings extending in a radial direction from the inner surface 114, through the body 112, to the outer surface 116 of the upper wiper plug 110.

The inner surface 114 of the body 112 may define an internal cavity 122 of the upper wiper plug 110. The internal cavity 122 may extend axially through the body 112 from an uphole end 123 to a downhole end 124 of the upper wiper plug 110. The internal cavity 122 may provide a flow path for materials, such as spacer fluids, cement slurry, or other wellbore materials, to pass through the upper wiper plug 110 during the liner cementing process. The inner surface 114 may define an upper plug dart seat 126 shaped to receive a plug portion of an upper plug dart during release of the upper wiper plug 110. The upper plug dart seat 126 may be axially disposed proximate the downhole end 124 of the upper wiper plug 110. In embodiments, the upper plug dart seat 126 may be disposed axially in the nose 120 portion of the upper wiper plug 110. In embodiments, the upper plug dart seat 126 may have a frustoconical shape, which may be operable to receive a conical or frustoconical-shaped plug portion of the upper plug dart. The upper plug dart seat 126 may have any other shape complimentary to the shape of the plug portion of the upper plug dart. The upper wiper plug 110 may comprise a downhole opening 128, which is disposed downhole from the upper plug dart seat 126 or at the downhole end of the upper plug dart seat 126. In embodiments, the inner surface 114 of the upper wiper plug 110 may have a smallest inner diameter Du disposed at the downhole end of the upper plug dart seat 126. The smallest inner diameter Du of the upper plug dart seat 126 may be large enough to pass a liner hanger setting ball through the upper wiper plug 110 without plugging the downhole opening 128 of the upper wiper plug 110. If the smallest inner diameter Du is too small, the liner hanger setting ball may plug the downhole opening 128, which may create fluid pressure sufficient to unintentionally and prematurely release the upper wiper plug 110.

Referring again to FIG. 4, the upper wiper plug 110 may further include an upper plug shear pin 125 that releasably secures the upper wiper plug 110 to the liner hanger running tool 50, such as to the inner string 52 extending downhole from the liner hanger running tool 50. In embodiments, the upper wiper plug 110 may be releasably secured to the liner hanger running tool 50. In embodiments, the liner hanger running tool 50 may comprise the inner string 32 extending in a downhole direction from the liner hanger running tool 50, and the upper wiper plug 110 may be releasably coupled to a downhole end of the inner string 52 of the liner hanger running tool 50. In embodiments, the inner surface 114 of the upper wiper plug 110 may be coupled to an outer surface of the inner string 52 with the upper plug shear pin 125. In embodiments, the upper wiper plug 110 may be releasably secured to the inner surface 32 of the liner 30 by an upper wiper plug hanging collar 302 (FIG. 9), as will be discussed in further detail in the present disclosure.

Referring again to FIG. 4, to release the upper wiper plug 110 from the liner hanger running tool 50, an upper plug dart is dropped downhole. A plug portion of the upper plug dart may seat in the upper plug dart seat 126, which closes off the downhole opening 128 of the upper wiper plug 110. Due to the flow restriction, fluid pressure uphole of the upper wiper plug 110 may increase to a pressure sufficient to shear the upper plug shear pin 125 that secures the upper wiper plug 110 to the liner hanger running tool 50. Shearing the upper plug shear pin 125 releases the upper wiper plug 110 from the liner hanger running tool 50, which allows the upper wiper plug 110 to translate in the downhole direction through the liner 30.

Referring again to FIG. 4, the lower wiper plug 130 is disposed downhole from the upper wiper plug 110. The lower wiper plug 130 may comprise a body 132, which may be a hollow cylindrical body comprising an inner surface 134 and an outer surface 136. The body 132 may be constructed of a drillable material, such as a rigid polymer or a drillable metal, such as aluminum or other soft metal. The lower wiper plug 130 may further include a plurality of wipers 138 coupled to the outer surface 136. Each of the wipers 138 may be an annular ring extending radially outward from the outer surface 136 of the lower wiper plug 130 and into contact with the inner surface 32 of the liner 30. Each of the wipers 138 may comprise a resilient material, such as a plastic or rubber material. The wipers 138 may wipe fluids and materials from the inner surface 32 of the liner 30 when the lower wiper plug 130 translates axially through the liner 30.

The lower wiper plug 130 may include a nose 140 at the downhole end 144 of the lower wiper plug 130. At the nose 140, the outer surface 136 of the lower wiper plug 130 may taper from a larger outer diameter to a smaller outer diameter at the downhole end 144 of the lower wiper plug 130. In embodiments, the outer surface 136 in the nose 140 portion of the lower wiper plug 130 may have a frustoconical shape having an outer diameter that decreases from a larger outer diameter at the uphole end of the nose 140 to a smallest outer diameter at the downhole end of the lower wiper plug 130. The nose 140 portion of the lower wiper plug 130 may have any other suitable shape that tapers to a smallest outer dimension at the downhole end 144 of the lower wiper plug 130.

Referring again to FIG. 4, the inner surface 134 of the body 132 may define an internal cavity 142 of the lower wiper plug 130. The internal cavity 142 may extend axially through the body 132 from an uphole end 143 to a downhole end 144 of the lower wiper plug 130. The internal cavity 142 may provide a flow path for materials, such as spacer fluids, cement slurry, or other materials, to pass through the lower wiper plug 130 during the liner cementing process. The inner surface 134 of the body 132 may define an upper wiper plug seat 145, which may be disposed axially proximate to the uphole end 143 of the lower wiper plug 130. The upper wiper plug seat 145 may be shaped to receive the nose 120 portion of the upper wiper plug 110 during the cementing operation. The upper wiper plug seat 145 may have a shape that tapers from a largest inner diameter at the uphole end 143 of the body 132 to a smaller inner diameter at the downhole end of the upper wiper plug seat 145. The upper wiper plug seat 145 may have a contour that is complimentary to a contour of the outer surface 116 of the upper wiper plug 110 in the nose 120 portion of the upper wiper plug 110.

The inner surface 134 may further define a lower plug dart seat 146 shaped to receive a plug portion of a lower plug dart. The lower plug dart seat 146 may be disposed axially proximate to the downhole end 144 of the lower wiper plug 130. The lower plug dart seat 146 may be disposed axially downhole from the upper wiper plug seat 145. In embodiments, the lower plug dart seat 146 may be disposed axially in the nose 140 portion of the lower wiper plug 130. In embodiments, the lower plug dart seat 146 may have a frustoconical shape, which may be operable to receive a conical or frustoconical-shaped lower plug dart. The lower plug dart seat 146 may have any other shape complimentary to the shape of the plug portion of the lower plug dart. The lower wiper plug 130 may comprise a downhole opening 148, which is disposed downhole from the lower plug dart seat 146 or at the downhole end of the lower plug dart seat 146. In embodiments, the inner surface 134 of the lower wiper plug 130 may have a smallest inner diameter DL disposed at the downhole end of the lower plug dart seat 146. In embodiments, the smallest inner diameter DL of the lower plug dart seat 146 of the lower wiper plug 130 may be less than the smallest inner diameter Du of the upper plug dart seat 126 of the upper wiper plug 110. The smallest inner diameter DL of the lower plug dart seat 146 may be large enough to pass the liner hanger setting ball through the lower wiper plug 130 without blocking the downhole opening 148 of the lower wiper plug 130. If the smallest inner diameter DL is too small, the liner hanger setting ball may plug the downhole opening 148 in the lower wiper plug 130, which may create fluid pressure sufficient to unintentionally and prematurely release the lower wiper plug 130.

The lower wiper plug 130 may include one or a plurality of side cement ports 147 extending through the body 132 of the lower wiper plug 130 from the inner surface 134 to the outer surface 135 of the lower wiper plug 130. The side cement ports 147 may allow the flow of wellbore materials past the lower wiper plug 130 when a downhole opening 148 of the lower wiper plug 130 is blocked, such as by a lower plug dart. When the lower plug dart blocks the downhole opening 148 in the lower wiper plug 130, wellbore materials, such as but not limited to spacer fluids or cement slurry, that are pumped downhole may pass through the cement side ports 147 to bypass the blocked downhole opening 148. In embodiments, the side cement ports 147 may be disposed axially between the nose 140 of the body 132 and the wipers 138.

Figure 5:
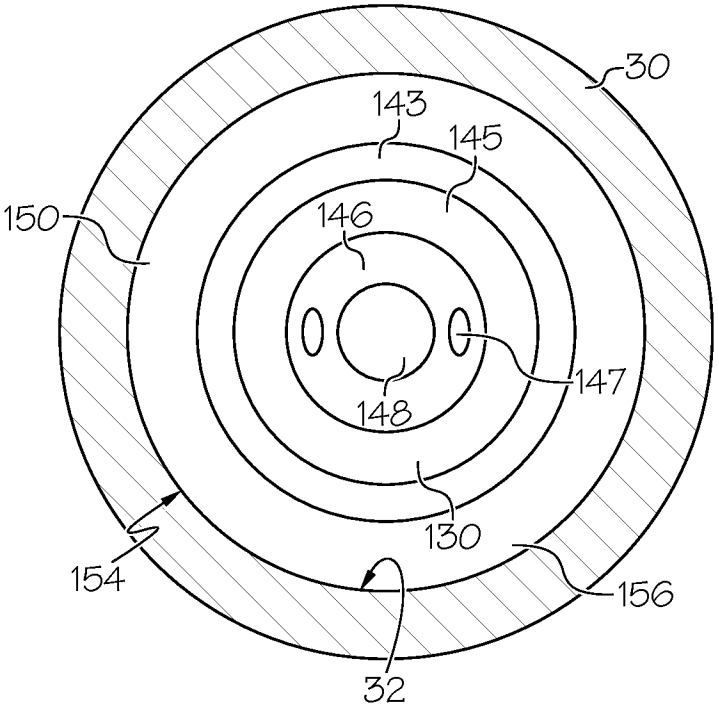
FIG. 5 schematically depicts a top view of the lower wiper plug and the lower wiper plug hanging collar of FIG. 4, according to one or more embodiments shown and described in this disclosure.

Referring now to FIGS. 4 and 5, the lower wiper plug 130 may be releasably secured to the inner surface 32 of the liner 30 by a lower wiper plug hanging collar 150. The lower wiper plug hanging collar 150 may be rigidly attached to the inner surface 32 of the liner 30 and the lower wiper plug 130 may be releasably secured to the lower wiper plug hanging collar 150. The lower wiper plug hanging collar 150 may be constructed of a drillable material, such as but not limited to a cement, a drillable metal, or a combination of both. As used throughout the present disclosure, the term "drillable metal" refers to a metal or metal alloy having a hardness less than a hardness of the components of the drill bit such that the drill bit can easily drill away the lower wiper plug hanging collar 150 when commencing drilling after cementing the liner 30 in the wellbore 10. Drillable metals can include, but are not limited to aluminum or aluminum alloys. In embodiments, the lower wiper plug hanging collar 150 can be a cement hanging collar. In other embodiments, the lower wiper plug hanging collar can be an aluminum or aluminum alloy hanging collar.

The lower wiper plug hanging collar 150 may have a shape that is generally an annular shape and may have a collar outer surface 154 and a collar inner surface 156. The collar outer surface 154 is rigidly attached to the inner surface 32 of the liner 30. The collar inner surface 156 of the lower wiper plug hanging collar 150 may define a central bore 158 extending axially through the lower wiper plug hanging collar 150. At the downhole end 160 of the lower wiper plug hanging collar 150, the collar inner surface 156 may be shaped to receive the uphole end 143 of the lower wiper plug 130. The lower wiper plug hanging collar 150 may further include a pin orifice 164 formed in the collar inner surface 156. The pin orifice 164 may extend from the collar inner surface 156 radially outward into the collar. The pin orifice 164 may be shaped to receive the lower plug shear pin 152. In embodiments, the lower wiper plug 130 may be releasably secured to the collar inner surface 156 of the lower wiper plug hanging collar 150.

At the uphole end 162 of the lower wiper plug hanging collar 150, the collar inner surface 156 may flare radially outward so that the inner dimension of the collar inner surface 156 is greatest at the uphole end 162 of the lower wiper plug hanging collar 150. In embodiments, the central bore 158 may have a frustoconical shape proximate to the uphole end 162 of the lower wiper plug hanging collar 150, where the frustoconical shape has an inner dimension that is greatest at the uphole end 162 of the lower wiper plug hanging collar 150 and decreases moving towards the downhole end 160. In particular, the frustoconical shape of central bore 158 may have a first diameter at the uphole end 162 of the lower wiper plug hanging collar 150 and a second diameter downhole of the first diameter, where the second diameter is less than the first diameter. The wider opening at the uphole end 162 of the lower wiper plug hanging collar 150 may help to guide the lower wiper plug dart to the lower wiper plug 130 and may help to guide the upper wiper plug 110 through the lower wiper plug hanging collar 150 during operation of the cementing string assembly 100. A smallest inner diameter of the lower wiper plug hanging collar 150 may be greater than a largest outside diameter of the body 112 of the upper wiper plug 110, so that the upper wiper plug 110 can pass through the lower wiper plug hanging collar 150. The largest outside diameter of the body 112 of the upper wiper plug 110 refers to the dimensions of the body 112 and does not include the overall outer dimension of the wipers 118, which may be resilient and can change shape under fluid pressure to fit through the central bore in the lower wiper plug hanging collar 150.

In embodiments, the lower wiper plug hanging collar 150 can be a cement collar. The cement collar of the lower wiper plug hanging collar 150 can be constructed by placing a cement plug in the liner 30 and allowing the cement plug to cure completely. Following curing of the cement, the cement plug is dressed from the uphole and downhole directions and the central bore 158 may then be drilled through the cement plug to form the lower wiper plug hanging collar 150. At the uphole end 162 of the cement plug, the central bore 158 may be counter sunk to form the inverted frustoconical shape to the central bore 158 at the uphole end 162 of the lower wiper plug hanging collar 150. The pin orifice 164 may be drilled in the collar inner surface 156 proximate to the downhole end 160 of the lower wiper plug hanging collar 150.

In embodiments in which the lower wiper plug hanging collar 150 is constructed of a drillable metal, the lower wiper plug hanging collar 150 may be formed according to known metal-working or metal-forming methods to produce the lower wiper plug hanging collar 150 and then the lower wiper plug hanging collar 150 can be rigidly attached to the inner surface 32 of the liner 30, such as by welding, adhering, press-fitting, attaching with one or more fasteners, or any other suitable method for rigidly attaching the lower wiper plug hanging collar 150 to the liner 30.

Referring to FIG. 4, as previously discussed, the lower wiper plug 130 may be releasably secured to the lower wiper plug hanging collar 150 with a pin, such as the lower plug shear pin 152. The lower plug shear pin 152 may be received in the pin orifice 164 formed in the lower wiper plug hanging collar 150. The lower plug shear pin 152 may be rigidly attached to the lower wiper plug hanging collar 150. In embodiments, the lower plug shear pin 152 may be screwed into the pin orifice 164 of the lower wiper plug hanging collar 150. The radially inward facing end of the lower plug shear pin 152 may be received in a recess in the body 132 of the lower wiper plug 130. In embodiments, the lower plug shear pin 152 may be configured to shear off when fluid pressure uphole of the lower wiper plug 130 increases above a threshold pressure to release the lower wiper plug 130 from the lower wiper plug hanging collar 150. The threshold pressure may depend on the material of construction and dimensions of the lower plug shear pin 152.

Referring again to FIG. 4, when releasably secured to the lower wiper plug hanging collar 150, the lower wiper plug 130 may be spaced apart from the upper wiper plug 110. In embodiments, the lower wiper plug 130 does not contact the upper wiper plug 110 when the lower wiper plug 130 is releasably secured to the lower wiper plug hanging collar 150. Therefore, the lower wiper plug 130 is not directly and releasably secured to the upper wiper plug 110. As a result, the lower wiper plug 130 can be released from the lower wiper plug hanging collar 150 without creating any incremental forces on the upper wiper plug 110 that could cause the upper wiper plug 110 to unintentionally and prematurely release from the liner hanger running tool 50.

Figure 6:
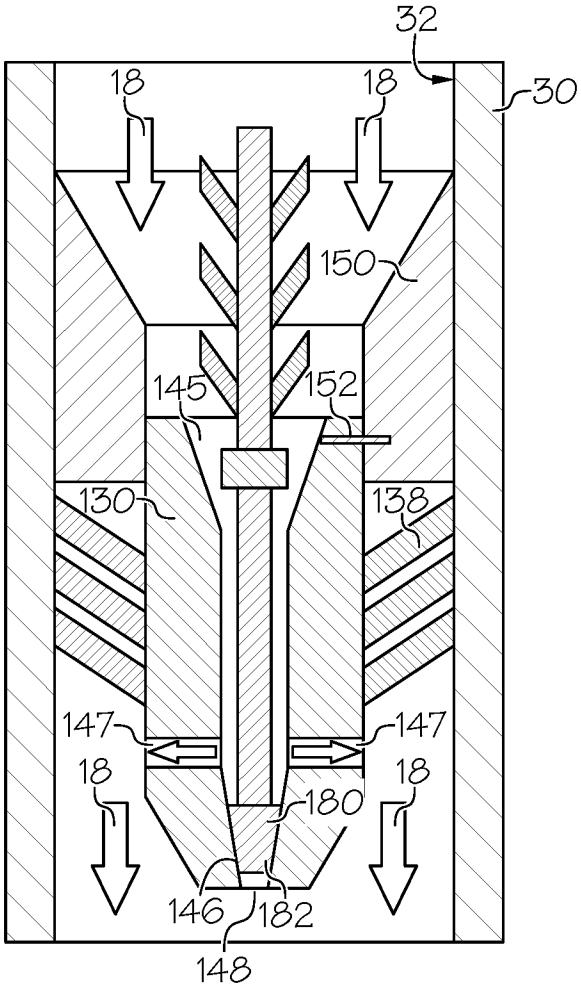
FIG. 6 schematically depicts a front cross-sectional view of the lower wiper plug of FIG. 4 during release of the lower wiper plug from the liner, according to one or more embodiments shown and described in this disclosure.

Referring now to FIG. 6, releasing the lower wiper plug 130 from the lower wiper plug hanging collar 150 may include dropping a lower plug dart 180 downhole from the surface into the drill pipe 42. The lower plug dart 180 passes through the drill pipe 42, the liner hanger running tool 50, and the upper wiper plug 110 and seats in the lower plug dart seat 146 of the lower wiper plug 130. In particular, a plug portion 182 of the lower plug dart 180 seats in the lower plug dart seat 146 of the lower wiper plug 130. Once seated in the lower plug dart seat 146, the plug portion 182 of the lower plug dart 180 blocks the downhole opening 148 in the nose 140 of the lower wiper plug 130. After the lower plug dart 180 is seated, wellbore materials 18, such as a spacer fluid followed by a cement slurry, are pumped downhole through the drill pipe 42. The lower plug dart 180 forces the wellbore materials 18 to flow through the cement side ports 147, which increases the fluid pressure uphole of the lower wiper plug 130. The increased fluid pressure caused by the flow restriction increases to a pressure sufficient to shear off the lower plug shear pin 152 securing the lower wiper plug 130 to the lower wiper plug hanging collar 150 to release the lower wiper plug 130. The lower wiper plug 130 may then travel downhole through the liner 30. Due to detachment and separation of the lower wiper plug 130 from the upper wiper plug 110, releasing the lower wiper plug 130 does not create any new incremental forces on the upper wiper plug 110 that could cause the upper wiper plug 110 to unintentionally and prematurely release from the liner hanger running tool 50.

Figure 7:
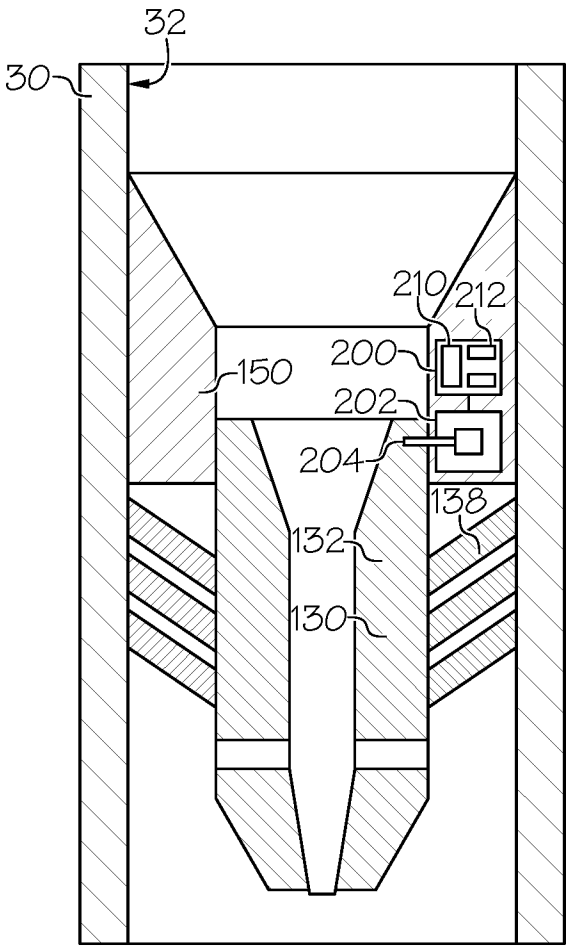
FIG. 7 schematically depicts a front cross-sectional view of another embodiment of a lower wiper plug hanging collar, according to one or more embodiments shown and described in this disclosure.

Referring now to FIG. 7, in embodiments, the lower wiper plug hanging collar 150 may include a radio frequency identification (RFID) receiver 200 and a motor 202 operatively coupled to a retractable pin 204. The RFID receiver 200, motor 202, and retractable pin 204 may be operable to electronically release the lower wiper plug 130 by retracting the retractable pin 204 with the motor 202 without the need for increasing the hydraulic pressure uphole of the lower wiper plug 130. Reducing or eliminating the need for increased hydraulic pressure uphole of the lower wiper plug 130 can further reduce the probability of unintentionally and prematurely releasing the upper wiper plug 110 while releasing the lower wiper plug 130. The lower wiper plug hanging collar 150 may further include a power source (not shown) for providing power for the RFID receiver 200 and the motor 202.

The lower plug shear pin 152 may be replaced with the retractable pin 204, which may be translated between an extended position and a retracted position. The retractable pin 204 may secure the lower wiper plug 130 to the lower wiper plug hanging collar 150 in the extended position and may release the lower wiper plug 130 from the lower wiper plug hanging collar 150 when in the retracted position. In embodiments, in the extended position, the retractable pin 204 may extend radially inward from the lower wiper plug hanging collar 150 into a recess or hole in the outer surface of the lower wiper plug 130. Engagement of the retractable pin 204 with the lower wiper plug 130, when the retractable pin 204 is in the extended position, may secure the lower wiper plug 130 to the lower wiper plug hanging collar 150. When the retractable pin 204 is translated to the retracted position, the retractable pin 204 may be moved in the radially outward direction, which may disengage the retractable pin 204 from the lower wiper plug 130 to release the lower wiper plug 130 from the lower wiper plug hanging collar 150. In embodiments, the retractable pin 204 may be a rigid pin. In embodiments, the retractable pin 204 may be a shearable pin, which can serve as a back-up release mechanism for the lower wiper plug 130 in the event of malfunction of the RFID receiver 200 or the motor 202.

Referring still to FIG. 7, the motor 202 may be operatively coupled to the retractable pin 204. In embodiments, the motor 202 may be directly and operatively coupled to the retractable pin 204. The motor 202 may be rigidly attached to the lower wiper plug hanging collar 150. In embodiments, the motor 202 may be indirectly coupled to the retractable pin 204, such as indirectly coupled to the retractable pin 204 through one or more linkages. When operated, the motor 202 may translate the retractable pin between the extended position and the retracted position. The motor 202 may be any type of motor capable of translating the retractable pin 204 between the extended position and retracted position. In embodiments, the motor 202 may be an electric motor. The motor 202 may be in electronic communication with the RFID receiver 200. The motor 202 may be operable to receive a control signal from the RFID receiver 200, where the control signal may cause the motor 202 to operate to translate the retractable pin 204 between the extended position and the retracted position.

Figure 8:
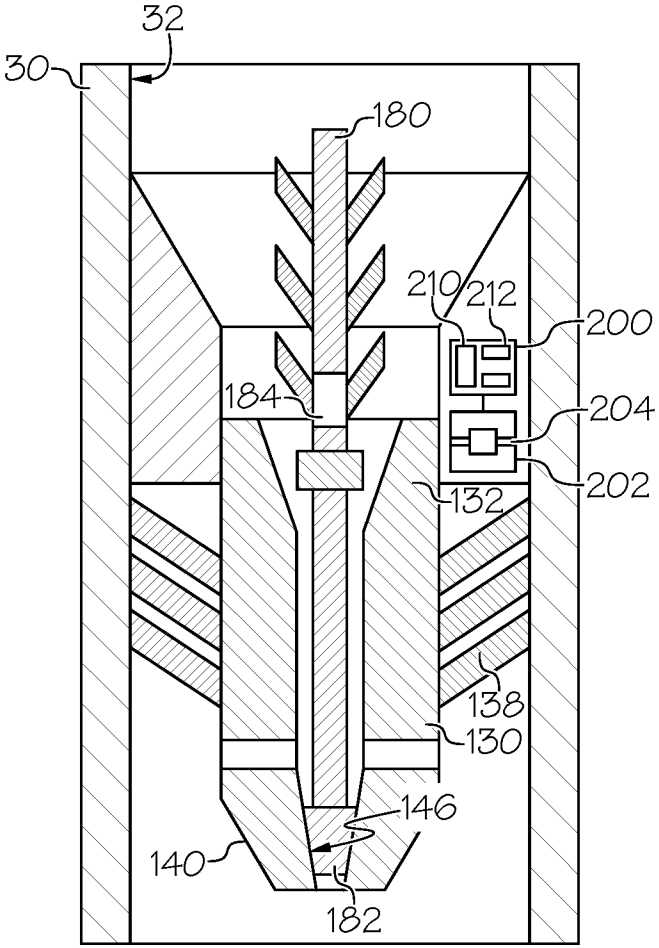
FIG. 8 schematically depicts a front cross-sectional view of the lower wiper plug hanging collar of FIG. 7 during release of the lower wiper plug from the lower wiper plug hanging collar, according to one or more embodiments shown and described in this disclosure.

Referring now to FIG. 8, the RFID receiver 200 may be rigidly attached to the lower wiper plug hanging collar 150. The RFID receiver 200 may be in electronic communication with the motor 202. The RFID receiver 200 may be configured to transmit an interrogatory pulse to a lower plug dart RFID tag 184 and receive a return signal transmitted by the lower plug dart RFID tag 184 attached to the lower plug dart 180. The RFID receiver 200 may be configured to determine whether the lower plug dart 180 is seated in the lower plug dart seat 146 of the lower wiper plug 130 from the signal received from the lower plug dart RFID tag 184. The RFID receiver 200 may be further configured to operate the motor 202 to retract the retractable pin 204 when the RFID receiver determines from the position of the lower plug dart RFID tag 184 that the lower plug dart 180 is seated in the lower wiper plug 130. In embodiment, the lower wiper plug hanging collar 150 may include a power source (not shown) electronically coupled to the RFID receiver 200, the motor 202, or both. In embodiments, the power source may be integrated with the RFID receiver 200, the motor 202, or both.

In embodiments, the RFID receiver 200 may include a hard-wired circuit that operates the motor when the RFID receiver 200 receives a signal transmitted by the lower plug dart RFID tag 184. In embodiments, the RFID receiver 200 may include a processor 210, at least one memory module 212 in electronically coupled to the processor 210, and computer readable and executable instructions stored on the at least one memory module 212. The computer readable and executable instructions, when executed by the processor, may cause the RFID receiver 200 to automatically receive a signal transmitted by the lower dart plug RFID tag 184 and operate the motor 202 in response to receiving the signal transmitted by the lower plug dart RFID tag 184. In embodiments, the machine readable and executable instructions, when executed by the processor, may cause the RFID receiver 200 to automatically receive the signal transmitted by the lower plug dart RFID tag 184 attached to the lower plug dart 180; determine whether the lower plug dart 180 is seated in the lower wiper plug 130 from the signal received from the lower plug dart RFID tag 184; when the lower plug dart 180 is seated in the lower wiper plug 130, operating the motor 202 to move the retractable pin 204 from the extended position to the retracted position. Moving the retractable pin 204 to the retracted position may release the lower wiper plug 130 from the lower wiper plug hanging collar 150.

Referring again to FIG. 8, in embodiments, releasing the lower wiper plug 130 from the lower wiper plug hanging collar 150 may include dropping a lower plug dart 180 downhole, where the lower plug dart 180 comprises the lower plug dart RFID tag 184. The method of releasing the lower wiper plug 130 may further include seating the plug portion 182 of the lower plug dart 180 in the lower plug dart seat 146 of the lower wiper plug 130. The method may include reading a position of the lower plug dart RFID tag 184 with the RFID receiver 200 and determining that the lower plug dart 180 is seated in the lower wiper plug 130 based on the position of the lower plug dart RFID tag 184. The method may further include, upon determining that the lower plug dart 180 is seated in the lower wiper plug 130, operating the motor 202 to move the retractable pin 204 to the retracted position to release the lower wiper plug 130 from the lower wiper plug hanging collar 150. The retractable pin 204 can be retracted with the motor 202 to release the lower wiper plug 130 without increasing the hydraulic pressure of wellbore materials 18 (spacer fluids or cement slurry) uphole of the lower wiper plug 130.

Figure 9:
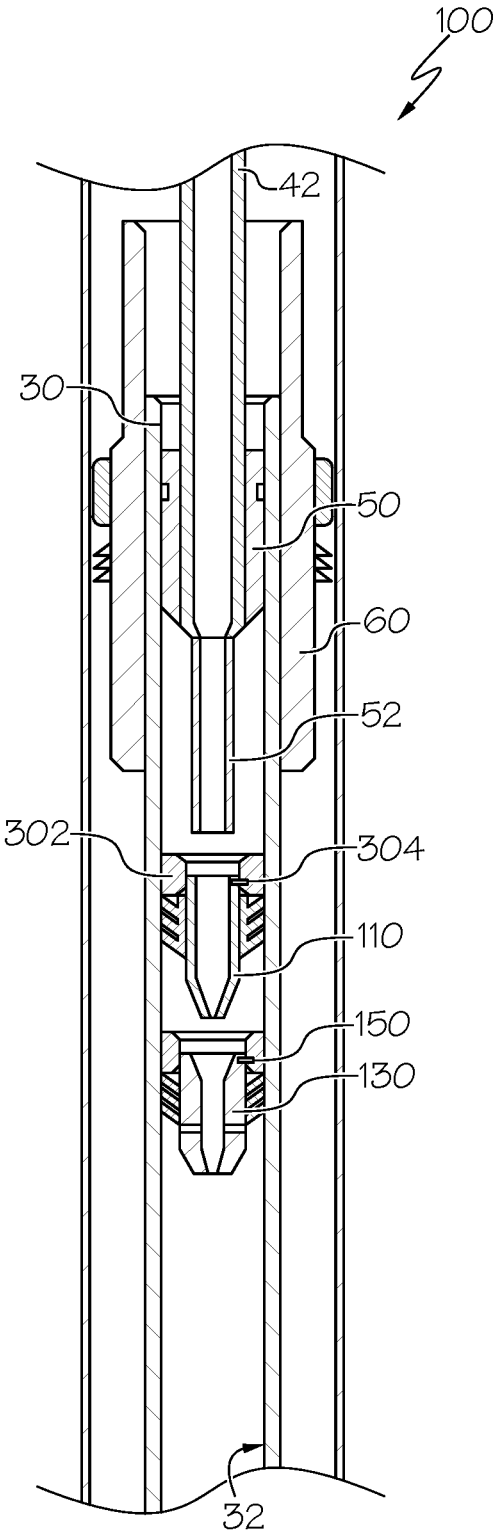
FIG. 9 schematically depicts a front cross-sectional view of another cementing string having an upper wiper plug releasably secured to an inner surface of a liner with an upper wiper plug hanging collar, according to one or more embodiments shown and described in this disclosure.

Referring now to FIG. 9, in embodiments, the upper wiper plug 110 may be releasably secured to the inner surface 32 of the liner 30 with an upper wiper plug hanging collar 302 and upper plug shear pin 304. The upper wiper plug hanging collar 302 may have any of the features previously described herein for the lower wiper plug hanging collar 150. Operation of the upper wiper plug hanging collar 302 may be the same as operation of the lower wiper plug hanging collar 150. The upper wiper plug hanging collar 302 may be rigidly attached to the inner surface 32 of the liner 30. The upper wiper plug hanging collar 302 may be spaced apart axially from the liner hanger running tool 50, the inner string 52 of the liner hanger running tool 50, or both. In embodiments, the upper wiper plug hanging collar 302 may include an RFID receiver, motor, and retractable pin (not shown) so that the upper wiper plug 110 can be released from the upper wiper plug hanging collar 302 electronically instead of by increasing the hydraulic pressure of fluids uphole of the upper wiper plug 110.

In embodiments, the cementing string assembly 100 can include a plurality of wiper plugs, each of which may be releasably coupled to the inner surface 32 of the liner 30 with a separate wiper plug hanging collar. Each of the wiper plugs may have features and characteristics similar to those previously discussed in this disclosure for the upper wiper plug 110, the lower wiper plug 130, or both. Each of the wiper plug hanging collars may have any of the features or characteristics described in the present disclosure for the lower wiper plug hanging collar 150. Each of the plurality of wiper plug hanging collars can include an RFID receiver, motor, and retractable pin so that each of the plurality of wiper plugs can be released electronically. When the cementing string assembly 100 comprises a plurality of wiper plugs and a plurality of wiper plug hanging collars, each successive wiper plug in the uphole direction may have a maximum outer diameter that is smaller than the minimum inside diameters of the wiper plug hanging collars disposed downhole from the wiper plug so that each wiper plug is able to pass through each of the wiper plug hanging collars positioned downhole.

Referring now to FIGS. 10-14, a method of cementing the liner 30 in the wellbore 10 using the cementing string assembly 100 of the present disclosure will now be discussed. The method of cementing the liner 30 in the wellbore 10 may include running the cementing string assembly 100 of the present disclosure downhole into the wellbore 10 to a liner setting depth and setting the liner hanger 60. After setting the liner hanger 60, the method may include releasing the lower wiper plug 130 from the lower wiper hanging collar 150 and pumping wellbore materials 18 downhole through the drill pipe 42, such as pumping a first spacer fluid followed by a cement slurry. Flow of the wellbore materials 18 (spacer fluid and the cement slurry) moves the lower wiper plug 130 downhole through the liner 30 to the landing collar 70, where the lower wiper plug 130 seats in the landing collar 70. After the lower wiper plug 130 seats in the landing collar 70, the wellbore materials 18, in particular the cement slurry, may continue to be pumped downhole through the drill pipe 42, which may cause the spacer fluid and cement slurry to flow through the lower wiper plug 130, the landing collar 70, the float collar 80, and the float shoe 84, and into the annulus 16 defined between the outer surface of the liner 30 and the wellbore wall 14 of the wellbore 10. At the end of the cement slurry, the method may include releasing the upper wiper plug 110 and pumping a second spacer fluid downhole through the drill pipe 42 followed by drilling mud. The flow of the second spacer fluid and drilling mud may move the upper wiper plug 110 downhole through the liner 30 to the landing collar 70, where the upper wiper plug 110 may seat in the lower wiper plug 130 to block the side cement ports 147 in the lower wiper plug 130. After the upper wiper plug 110 seats in the lower wiper plug 130, the method may include ceasing pumping the drilling fluid downhole and then curing the cement slurry in the annulus 16.

In the first step, the cementing string assembly 100 is made up and run downhole to the liner setting depth. The liner setting depth refers to the downhole position at which the liner 30 is to be installed. After reaching the liner setting depth, setting the liner hanger 60 may include dropping a hanger setting ball (not shown) inside the drill pipe 42 and pumping a wellbore material 18 from the surface down to a ball seat profile inside the liner hanger running tool 50, or in the landing collar 70. The liner hanger 60 may be set hydraulically by increasing the fluid hydrostatic pressure in the drill pipe 42. Once the liner hanger 60 is set, the method may include releasing the liner hanger running tool 50 and blowing the hanger setting ball through the ball seat by further increasing the fluid pressure in the drill pipe 42. The hanger setting ball may pass downhole through the upper wiper plug 110, the lower wiper plug 130, and the liner 30 to the landing collar 70. Referring to FIG. 10, in embodiments, the setting ball 170 may pass through the wiper plug seat 72 in the landing collar 70 and may end up in the central cavity 76 of the landing collar 70.

Referring now to FIG. 10, after setting the liner hanger 60, the methods may include releasing the lower wiper plug 130. Releasing the lower wiper plug 130 may include dropping the lower plug dart 180 downhole and then pumping a spacer fluid followed by a cement slurry downhole through the drill pipe 42. The lower plug dart 180 may comprise a plug portion 182 and one or more wipers (not shown) attached to the lower plug dart 180 uphole of the plug portion 182. As the lower plug dart 180 travels down the drill pipe 42, the wipers of the lower plug dart 180 may wipe off the drilling fluid (drilling mud) from inside the drill pipe 42 to reduce or prevent contamination of the cement slurry with the drilling fluid.

The lower plug dart 180 may pass through the upper wiper plug 110 and may land inside the lower wiper plug 130. As shown in FIG. 10, the lower plug dart 180 may land in the lower wiper plug 130 with the plug portion 182 of the lower plug dart 180 seated in the lower plug dart seat 146 defined by the inner surface 134 of the lower wiper plug 130. In embodiments, when seated, the plug portion 182 of the lower plug dart 180 may block the downhole opening 148 in the lower wiper plug 130, which may restrict the flow of wellbore materials 18 only to flow through the side cement ports 147 of the lower wiper plug 130. Restricting the fluid flow downhole increases the fluid pressure in the cementing string assembly 100 uphole of the lower wiper plug 130. The increased fluid pressure caused by restricting the flow of materials only to flow through the side cement ports 147 may shear the lower plug shear pin 152, which releases the lower wiper plug 130 from the lower wiper plug hanging collar 150. The flow of wellbore materials 18 through the side cement ports 147 may create shear forces on the lower plug shear pin 152 until the lower plug shear pin 152 shears off. Because the lower wiper plug 130 is detached and separated from the upper wiper plug 110, the fluid pressure that shears the lower plug shear pin 152 does not produce any additional forces on the upper wiper plug 110, which reduces or eliminates the probability of unintentionally and prematurely releasing the upper wiper plug 110 while releasing the lower wiper plug 130.

Referring again to FIGS. 7 and 8, in embodiments, the lower plug dart 180 may have a lower plug dart RFID tag 184 attached to the lower plug dart 180, and the lower wiper plug hanging collar 150 may comprise the RFID receiver 200, motor 202, and retractable pin 204. In these embodiments, releasing the lower wiper plug 130 from the lower wiper plug hanging collar 150 may include dropping the lower plug dart 180 downhole, seating the lower plug dart 180 in the lower plug dart seat 146 of the lower wiper plug 130, reading the lower plug dart RFID tag 184 with the RFID receiver 200, determining that the lower plug dart 180 is seated in the lower wiper plug 130 from a position of the lower plug dart RFID tag 184 relative to the RFID receiver 200, and after determining that the lower plug dart 180 is seated in the lower wiper plug 130, operating the motor 202 to move the retractable pin 204 from an extended position to a retracted position, which releases the lower wiper plug 130 from the lower wiper plug hanging collar 150. Releasing the lower wiper plug 130 using the RFID receiver 200, motor 202, and retractable pin 204 may release the lower wiper plug 130 without producing any additional forces on the upper wiper plug 110, which reduces or eliminates the probability of unintentionally and prematurely releasing the upper wiper plug 110 while releasing the lower wiper plug 130

Figure 11:
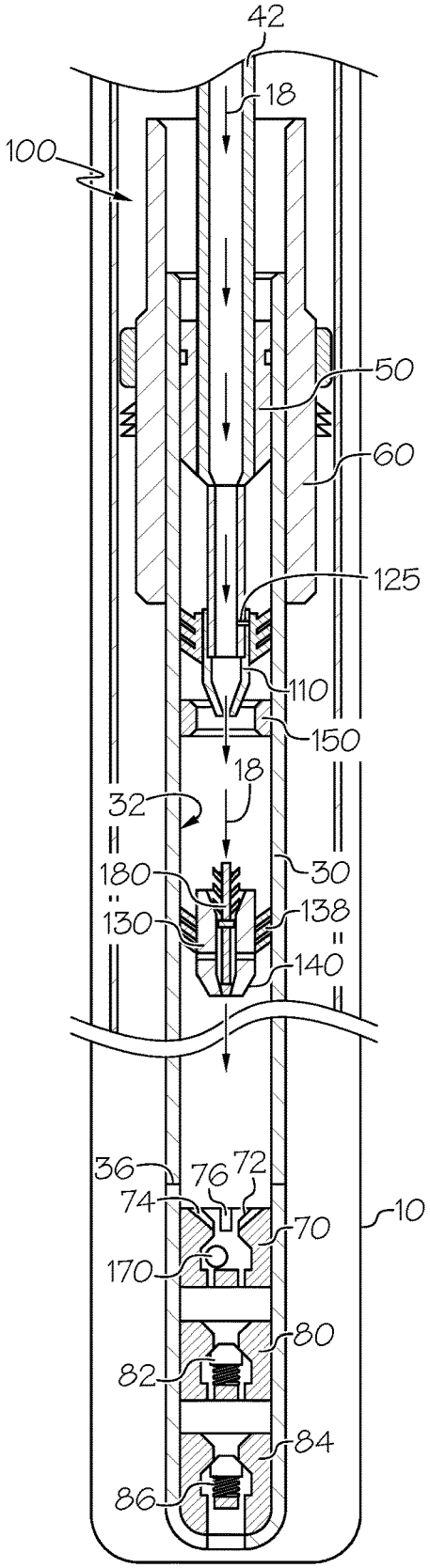
FIG. 11 schematically depicts a front cross-sectional view of the cementing string of FIG. 10 after release of the lower wiper plug, according to one or more embodiments shown and described in this disclosure.

Referring now to FIG. 11, after the lower wiper plug 130 is released from the lower wiper plug hanging collar 150, continued pumping of the wellbore materials, such as the cement slurry, downhole through the drill pipe 42 may cause the lower wiper plug 130 to travel downhole through the liner 30. As the lower wiper plug 130 travels downhole through the liner 30, the wipers 138 of the lower wiper plug 130 may wipe drilling fluids or drilling mud off the inner surface 32 of the liner 30, which may reduce or prevent contamination of the cement slurry with drilling fluid.

Figure 12:
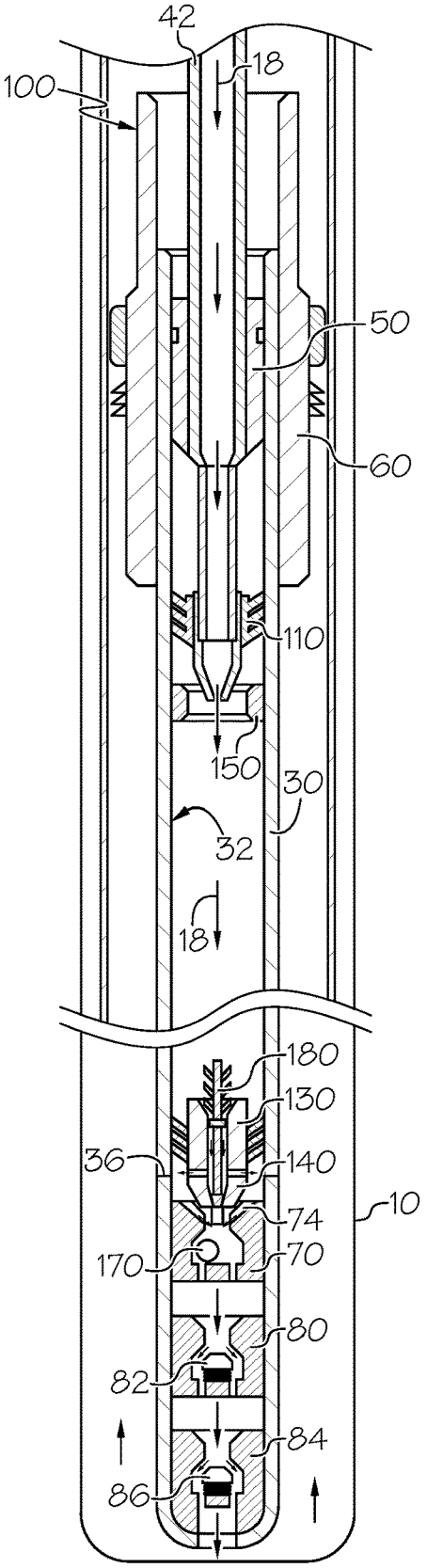
FIG. 12 schematically depicts a front cross-sectional view of the cementing string of FIG. 11 during release of an upper wiper plug and with the lower wiper plug seated in a landing collar of the cementing string, according to one or more embodiments shown and described in this disclosure.

Referring now to FIG. 12, at the downhole end 36 of the liner 30, the lower wiper plug 130 may land inside the landing collar 70. In embodiments, the lower wiper plug 130 may land in the landing collar 70 with the nose 140 of the lower wiper plug 130 seated in the wiper plug seat 72 of the landing collar 70. Continued pumping of the cement slurry downhole may cause the wellbore materials, such as the spacer fluid and cement slurry, to flow through the lower wiper plug 130, the landing collar 70, and the float collar 80 to fill the float shoe 84 and the annulus 16 defined between the liner 30 and the wellbore wall 14. In embodiments, the wellbore materials 18 (spacer fluid and cement slurry) may flow through the cement side ports 147 of the lower wiper plug 130. The wellbore materials 18 may then flow through the grooves 74 or channels in the surface of the wiper plug seat 72 and through the central cavity 76 of the landing collar 70. The wellbore materials 18, in particular the cement slurry, may continue to flow down through the float collar 80 and the float shoe 84. The check valves 82, 86 in the float collar 80 and float shoe 84, respectively, may prevent backflow of the wellbore materials 18, such as the cement slurry, back up into the cement string assembly 100. The wellbore materials 18 are forced to flow back uphole through the annulus 16. In embodiments, a fixed volume of the cement slurry may be pumped downhole after the first spacer fluid. The fixed volume of the cement slurry may be sufficient to fill the annulus 16 between the liner 30 and the wellbore wall 14 along substantially the entire length of the liner 30.

Figure 13:
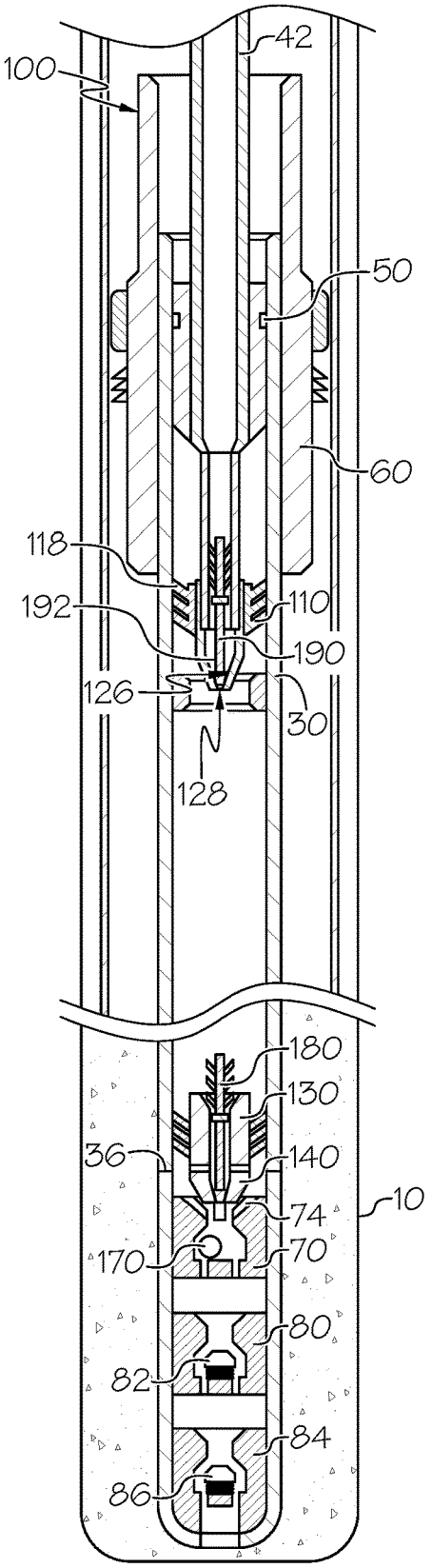
FIG. 13 schematically depicts a front cross-sectional view of the cementing string of FIG. 12 following release of the upper wiper plug, according to one or more embodiments shown and described in this disclosure.

Referring now to FIG. 13, after the fixed volume of the cement slurry is pumped downhole, the upper wiper plug 110 may be released. Releasing the upper wiper plug 110 may include, after pumping the fixed volume of the cement slurry downhole, dropping an upper plug dart 190 downhole. The upper plug dart 190 may be followed by pumping a second spacer fluid downhole through the drill pipe 42 followed by a drilling fluid, such as drilling mud. The upper plug dart 190 may comprise a plug portion 192 and one or more wipers (not shown) attached to the upper plug dart 190 uphole of the plug portion 192. As the upper plug dart 190 travels down the drill pipe 42, the wipers of the upper plug dart 190 may wipe off the cement slurry (drilling mud) from inside the drill pipe 42 to reduce or prevent contamination of the drilling fluid with the cement slurry.

The upper plug dart 190 may land on top of or inside the upper wiper plug 110. In embodiments, the upper plug dart 190 may land in the upper wiper plug 110 with the plug portion 192 of the upper plug dart 190 seated in the upper plug dart seat 126 defined by the inner surface 114 of the upper wiper plug 110. In embodiments, when seated, the plug portion 192 of the upper plug dart 190 may block the downhole opening 128 in the upper wiper plug 110, which may block the flow of the spacer fluid, drilling fluid, or both through the upper wiper plug 110 and increase the fluid pressure uphole of the upper wiper plug 110. The fluid pressure caused by blocking the downhole opening 128 of the upper wiper plug 110 may shear the upper plug shear pin 125, which releases the upper wiper plug 110 from the liner hanger running tool 50, inner string 52, or an upper wiper plug hanging collar rigidly attached to the inner surface 32 of the liner 30.

In embodiments, the upper wiper plug 110 may be releasably secured to the inner surface 32 of the liner 30 by an upper wiper plug hanging collar (not shown). In embodiments, the upper wiper plug hanging collar may include an RFID receiver, motor, and retractable pin similar to those previously described in conjunction with the lower wiper plug hanging collar 150 in FIG. 7. When the upper wiper plug 110 is releasably secured to an upper wiper plug hanging collar having an RFID receiver, motor, and retractable pin, the upper wiper plug 110 may be released electronically. In embodiments, releasing the upper wiper plug 110 may include dropping the upper plug dart 190 downhole, where the upper plug dart 190 comprises an upper dart RFID tag (not shown). Releasing the upper wiper plug 110 may further include seating the upper plug dart 190 in the upper plug dart seat 126 of the upper wiper plug 110, reading the upper dart RFID tag with the RFID receiver, determining that the upper plug dart 190 is seated in the upper wiper plug 110 from a position of the upper dart RFID tag relative to the RFID receiver, and after determining that the upper plug dart 190 is seated in the upper wiper plug 110, operating the motor to move the retractable pin from an extended position to a retracted position, which releases the upper wiper plug 110 from the upper wiper plug hanging collar.

Referring again to FIG. 13, after the upper wiper plug 110 is released, continued pumping of the wellbore materials, such as the second spacer fluid and drilling fluid, downhole may cause the upper wiper plug 110 to travel downhole through the liner 30. As the upper wiper plug 110 travels downhole through the liner 30, the wipers 118 of the upper wiper plug 110 wipes residual cement slurry off of the inner surface 32 of the liner 30, which may reduce or prevent contamination of the drilling fluid with the cement slurry.

Figure 14:
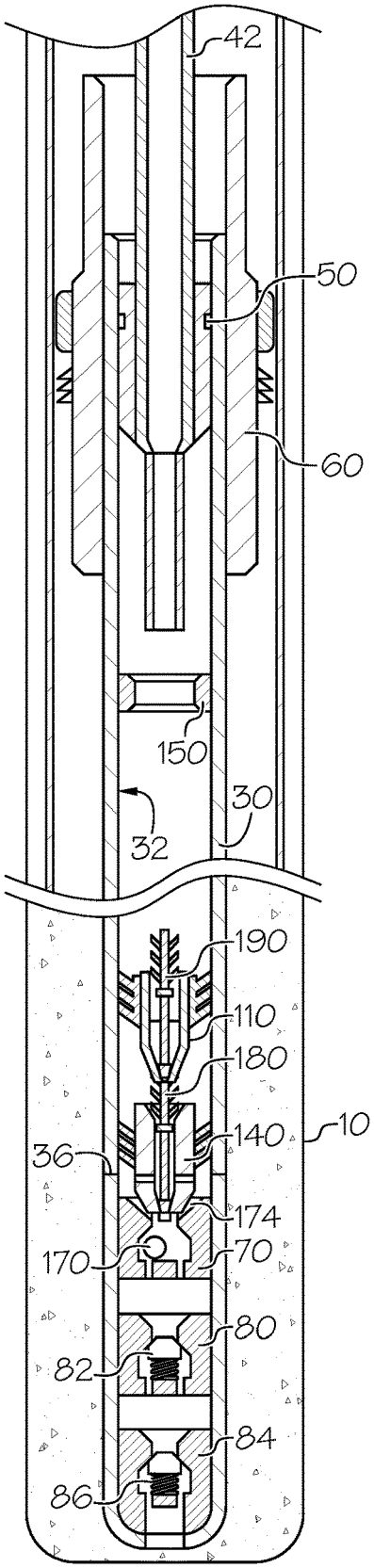
FIG. 14 schematically depicts a front cross-sectional view of the cementing string of FIG. 13 with the lower wiper plug seated with the upper wiper plug, according to one or more embodiments shown and described in this disclosure.

Referring now to FIG. 14, at the downhole end 36 of the liner 30, the upper wiper plug 110 may land on top of or inside the lower wiper plug 130, which is seated in the landing collar 70. In embodiments, the upper wiper plug 110 may seat in the upper wiper plug seat 145 at the uphole end 143 of the lower wiper plug 130. When seated in the upper wiper plug seat 145, the upper wiper plug 110 may block the side cement ports 147 of the lower wiper plug 130, which increases the fluid pressure of the drilling fluid uphole of the upper wiper plug 110. Upon detecting the change in fluid pressure at the surface of the wellbore 10, the pumping of the drilling fluid downhole can be stopped. In embodiments, the method of cementing the liner 30 in the wellbore 10 may include ceasing pumping of the drilling fluid downhole. In embodiments, the method of cementing the liner 30 in the wellbore 10 may include detecting the change in fluid pressure at the surface caused by blocking the side cement ports 147 in the lower wiper plug 130 by the upper wiper plug 110 and, in response to the increase in fluid pressure, ceasing pumping the drilling fluid downhole through the drill pipe 42.

The cement slurry may be allowed to cure in the annulus 16 to cement the liner 30 to the wellbore wall 14 of the wellbore 10. During or after curing, the drill pipe 42, liner hanger running tool 50, or both may be pulled out to the surface 12 of the wellbore 10. Once the cement is cured sufficiently, a drill string comprising a drill bit may be run downhole through the liner 30 and operated to drill out the upper wiper plug 110, the lower wiper plug 130, the landing collar 70, the float collar 80, and the float shoe 84 before drilling the next interval of the wellbore 10.

As previously discussed, in embodiments, the lower wiper plug hanging collar 150, an upper wiper plug hanging collar, or both can include an RFID receiver 200, which may, in some embodiments, include a processor 210 for operating the hanging collar. The processor 210 described in the present disclosure is one contemplated example of suitable computing devices but does not suggest any limitation on the scope of any embodiments presented. Nothing illustrated or described with respect to the processor 210 should be interpreted as being required or as creating any type of dependency with respect to any element or plurality of elements of the present disclosure. It is understood that various methods and control schemes described in the present disclosure may be implemented using one or more analog control devices in addition to or as an alternative to the processor 210. The processor 210 may include, but is not limited to, one or more of an industrial controller, desktop computer, laptop computer, server, client computer, tablet, smartphone, or any other type of device that can send data, receive data, store data, and perform one or more calculations. In embodiments, each of the RFID receivers 200 may include at least one processor 210 and at least one memory module 212. Any of the processors 210 may be communicatively coupled to one or more output devices, such as the motor 202 or other output device. In embodiments, the RFID receivers 200 may further include one or more input devices which can include, by way of example, any type of mouse, keyboard, keypad, push button array, switches, disk or media drive, memory stick (thumb drive), memory card, pen, touch-input device, biometric scanner, audio input device, sensors, or combinations of these.

Any of the memory modules described in the present disclosure may include a non-volatile memory (ROM, flash memory, etc.), volatile memory (RAM, etc.), or a combination of these. The RFID receivers 200 of the present disclosure can include a network interface device, which can facilitate communication with the input devices and output devices or over a network via wires, via a wide area network, via a local area network, via a personal area network, via a cellular network, via a satellite network, or a combination of these. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, other near field communication protocols, or combinations of these. Suitable personal area networks may similarly include wired computer buses such as, for example, USB and FireWire. Suitable cellular networks include, but are not limited to, technologies such as LTE, WiMAX, UMTS, CDMA, and GSM. The network interface can be communicatively coupled to any device capable of transmitting data, receiving data, or both via a network. The network interface devices of the present disclosure may also be capable of communicating wirelessly with one or more system components by transmitting vibrations, sound waves, or other signals through the material comprising the casing of the wellbore 10.

The hardware of the network interface devices can include a communication transceiver for sending, receiving, or both, any wired or wireless communication. Various components, such as but not limited to the motor 202, may utilize one or more network interface devices to communicate with the processor 210 through the network. For example, the hardware of the network interface devices may include an antenna, a modem, LAN port, Wi-Fi card, WiMax card, mobile communications hardware, near-field communication hardware, satellite communication hardware and/or any wired or wireless hardware for communicating with other networks and/or devices.

The one or more memory modules described in the present disclosure may include one or a plurality of computer readable storage mediums, each of which may be either a computer readable storage medium or a computer readable signal medium. A computer readable storage medium may reside, for example, within an input device, non-volatile memory, volatile memory, or any combination thereof. A computer readable storage medium can include tangible media that is able to store instructions associated with, or used by, a device or system. A computer readable storage medium includes, by way of non-limiting examples: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave.

The depictions of the RFID receivers 200 in the drawings include simplified representations of the processor 210 and memory module 212. Many components of the RFID receivers 200 have been omitted for purposes of clarity. Assembling various hardware components into a functioning RFID receiver 200 or other control device is considered to be part of the ordinary skill in the art. The various hardware components, in particular the hardware components for the RFID receivers 200 and motor 202, may be suitable for operation under downhole conditions, such as at downhole temperature and pressure conditions.

It is noted that recitations herein of a component of the present disclosure being "configured," "structured," or "programmed" in a particular way, to embody a particular property, or to function in a particular manner, are structural recitations, as opposed to recitations of intended use. More specifically, the references herein to the manner in which a component is "configured," "structured," or "programmed" denotes an existing physical condition of the component and, as such, is to be taken as a definite recitation of the structural characteristics of the component.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A cementing string assembly for cementing a liner in a wellbore, the cementing string assembly comprising:

a drill pipe;

a liner hanger running tool attached to a downhole end of the drill pipe;

a liner releasably secured to the drill pipe by the liner hanger running tool;

an upper wiper plug disposed within the liner and releasably secured to the liner hanger running tool or to the liner; and a lower wiper plug disposed within the liner and releasably secured to the liner downhole of the upper wiper plug, where:

the lower wiper plug is releasably secured to an inner surface of the liner by a wiper plug hanging collar;

when the upper wiper plug is releasably secured to the liner running tool or the liner and the lower wiper plug is releasably secured to the liner, the lower wiper plug is not rigidly attached to or releasably secured to the upper wiper plug; and the lower wiper plug is releasable from the liner independent of the upper wiper plug and without exerting incremental mechanical or hydraulic pressure forces on the upper wiper plug.

2. The cementing string assembly of claim 1, where the lower wiper plug is releasably secured to the wiper plug hanging collar by a pin coupled to the wiper plug hanging collar.

3. The cementing string assembly of claim 2, where the pin is a shear pin rigidly attached to the wiper plug hanging collar and the pin is received in a recess in a body of the lower wiper plug.

4. The cementing string assembly of claim 1, where the wiper plug hanging collar comprises a drillable material, where the drillable material comprises cement, a drillable metal, or a combination of both.

5. The cementing string assembly of claim 1, where the wiper plug hanging collar comprises an inner surface defining a central bore extending axially through the wiper plug hanging collar, where the lower wiper plug is releasably secured to the inner surface of the wiper plug hanging collar.

6. The cementing string assembly of claim 5, where:

the inner surface of the wiper plug hanging collar comprises a frustoconical profile at an uphole end of the wiper plug hanging collar;

the frustoconical profile comprises a first diameter at the uphole end of the wiper plug hanging collar and a second diameter downhole of the first diameter; and the first diameter is larger than the second diameter.

7. The cementing string assembly of claim 1, where the wiper plug hanging collar comprises a retractable pin, a motor, an RFID receiver, and an electrical power source electrically coupled to the RFID receiver and the motor, where:

the retractable pin is movable between an extended position and a retracted position;

the retractable pin engages with the lower wiper plug in the extended position to secure the lower wiper plug to the wiper plug hanging collar in the extended position and releases the lower wiper plug from the wiper plug hanging collar when in the retracted position;

the motor is in electronic communication with the RFID receiver and operatively connected to the retractable pin;

when operated, the motor moves the retractable pin between the extended position and the retracted position; and the RFID receiver is configured to recognize when a lower plug dart RFID tag is proximate the wiper plug hanging collar and to operate the motor to retract the retractable pin when the RFID receiver recognizes the lower plug dart RFID tag is proximate the wiper plug hanging collar.

8. The cementing string assembly of claim 7, where the RFID receiver comprises at least one processor, at least one memory module, and machine readable and executable instructions stored on the at least one processor, where the machine readable and executable instructions, when executed by the processor, cause the RFID receiver to automatically:

determine a position of a lower plug dart RFID tag attached to a lower plug dart;

determine whether the lower plug dart is seated in the lower wiper plug from the positon of the lower plug dart RFID tag; and when the lower plug dart is seated in the lower wiper plug, operating the motor to move the retractable pin from the extended position to the retracted position.

9. The cementing string assembly of claim 1, where the lower wiper plug comprises a body having an inner surface and an outer surface and a plurality of wipers attached to an outer surface of the body and extending radially outward from the outer surface of the body, where the inner surface of the body defines an internal cavity extending axially through the lower wiper plug from an uphole end to a downhole end of the lower wiper plug.

10. The cementing string assembly of claim 9, where the inner surface of the body of the lower wiper plug comprises a lower dart seat and an upper wiper plug seat disposed uphole from the lower plug dart seat, where:

the lower plug dart seat is shaped to receive a lower plug dart; and the upper wiper plug seat is shaped to receive a nose of the upper wiper plug.

11. The cementing string assembly of claim 1, where the lower wiper plug comprises one or a plurality of side cement ports extending radially outward through a body of the lower wiper plug.

12. The cementing string assembly of claim 1, where the upper wiper plug is releasably secured to the liner hanger running tool.

13. The cementing string assembly of claim 1, where the upper wiper plug is releasably secured to an inner surface of the liner by an upper wiper plug hanging collar.

14. The cementing string assembly of claim 1, where the lower wiper plug is spaced apart from the upper wiper plug.

15. The cementing string assembly of claim 1, further comprising a landing collar rigidly secured to a downhole end of the liner, where the landing collar comprises a wiper plug seat shaped to receive a downhole end of the lower wiper plug.

16. A method of cementing a liner in a wellbore, the method comprising:

running a cementing string assembly into the wellbore to a liner setting depth, where the cementing string assembly comprises:

a drill pipe;

a liner hanger running tool attached to a downhole end of the drill pipe;

a liner releasably secured to the drill pipe by the liner hanger running tool;

an upper wiper plug disposed within the liner and releasably secured to the liner hanger running tool or to the liner;

a lower wiper plug disposed within the liner and releasably secured to the liner downhole of the upper wiper plug, where:

the lower wiper plug is detached from the upper wiper plug;

the lower wiper plug is releasably secured to an inner surface of the liner by a wiper plug hanging collar; and the lower wiper plug is releasable from the liner independent of the upper wiper plug and without exerting mechanical forces on the upper wiper plug;

a landing collar rigidly secured to a downhole end of the liner, where the landing collar comprises a wiper plug seat shaped to receive a downhole end of the lower wiper plug; and a liner hanger secured to an outer surface of the liner proximate to an uphole end of the liner;

setting the liner hanger;

after setting the liner hanger, releasing the lower wiper plug from the lower wiper hanging collar;

pumping a first spacer fluid downhole followed by a cement slurry, where flow of the spacer fluid and the cement slurry moves the lower wiper plug downhole through the liner to the landing collar, where the lower wiper plug seats in the landing collar;

after the lower wiper plug seats in the landing collar, continuing pumping the cement slurry downhole, where continued flow of cement slurry causes the spacer fluid and the cement slurry to flow through the lower wiper plug and the landing collar, and into an annulus defined between an outer surface of the liner and a wellbore wall of the wellbore;

releasing the upper wiper plug;

pumping a second spacer fluid downhole followed by drilling mud, where the flow of the second spacer fluid and drilling mud moves the upper wiper plug downhole through the liner to the landing collar, where the upper wiper plug seats in the lower wiper plug and blocks at least one side cement port in the lower wiper plug;

ceasing pumping the drilling fluid downhole; and curing the cement slurry in the annulus.

17. The method of claim 16, where releasing the lower wiper plug comprises dropping a lower plug dart downhole, where:

the lower plug dart seats in a lower dart seat in the lower wiper plug;

when seated, the lower plug dart blocks a downhole opening in the lower wiper plug, which restricts flow of materials only through the at least one side cement port of the lower wiper plug; and fluid pressure caused by restricting the flow of materials only through the at least one side cement port shears a lower plug shear pin, which releases the lower wiper plug from the lower wiper plug hanging collar.

18. The method of claim 16, where:

the lower wiper plug hanging collar comprises an RFID receiver, a motor electrically coupled to the RFID receiver, and a retractable pin operatively coupled to the motor, where the retractable pin secures the lower wiper plug to the lower wiper plug hanging collar when the retractable pin is in an extended position; and releasing the lower wiper plug comprises:

dropping a lower plug dart downhole, where the lower plug dart comprises a lower dart RFID tag;

seating the lower plug dart in a lower dart seat of the lower wiper plug;

reading the lower dart RFID tag with the RFID receiver;

determining that the lower plug dart is seated in the lower wiper plug from a position of the lower dart RFID tag relative to the RFID receiver; and after determining that the lower plug dart is seated in the lower wiper plug; operating the motor to move the retractable pin from an extended position to a retracted position, which releases the lower wiper plug from the lower wiper plug hanging collar.

* * * * *